US009093734B2

(12) United States Patent
Gorbachov

(10) Patent No.: US 9,093,734 B2
(45) **Date of Patent: *Jul. 28, 2015**

(54) MINIATURE RADIO FREQUENCY DIRECTIONAL COUPLER FOR CELLULAR APPLICATIONS

(71) Applicant: RFAXIS, INC, Irvine, CA (US)

(72) Inventor: Oleksandr Gorbachov, Irvine, CA (US)

(73) Assignee: RFAXIS, INC., Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/251,197

(22) Filed: Apr. 11, 2014

(65) Prior Publication Data

US 2014/0306778 A1 Oct. 16, 2014

Related U.S. Application Data

(60) Provisional application No. 61/811,455, filed on Apr. 12, 2013.

(51) Int. Cl.
*H01P 5/18* (2006.01)

(52) U.S. Cl.
CPC . *H01P 5/18* (2013.01); *H01P 5/184* (2013.01)

(58) Field of Classification Search
CPC ..... H01P 5/04; H01P 5/028; H01P 5/12; H01P 5/16; H01P 5/18; H01P 5/184; H01P 5/185; H01P 5/187; H01P 5/19227; H03H 7/00; H03H 7/0115; H03H 7/18; H03H 7/185; H03H 7/19; H03H 7/2021; H03H 7/25; H03H 7/34; H03H 7/383; H03H 7/42; H03H 7/422; H03H 7/46; H03H 7/48; H03H 7/05; H03H 7/04
USPC ..... 333/109–112, 115–119, 238
See application file for complete search history.

(56) References Cited

U.S. PATENT DOCUMENTS

| | | | | |
|---|---|---|---|---|
| 6,407,647 | B1 | 6/2002 | Apel et al. | |
| 2008/0297272 | A1 | 12/2008 | Toujo et al. | |
| 2009/0189712 | A1 | 7/2009 | Jiang | |
| 2009/0212887 | A1 * | 8/2009 | Rofougaran | 333/24 R |
| 2011/0063044 | A1 | 3/2011 | Jones | |
| 2011/0267194 | A1 | 11/2011 | Hong et al. | |
| 2012/0161898 | A1 | 6/2012 | Gorbachov | |

OTHER PUBLICATIONS

International Search Report and Written Opinion for corresponding Patent Cooperation Treaty Application. PCT/US2014/033863; Aug. 22, 2014; 9 Pages.

* cited by examiner

*Primary Examiner* — John Poos
*Assistant Examiner* — David Mattison
(74) *Attorney, Agent, or Firm* — Stetina Brunda Garred & Brucker

(57) ABSTRACT

A directional coupler with increased directivity and reduced overall footprint area is disclosed. There is an input port, an output port, a coupled port, and a ballasting port. A primary chain of serially connected inductors is connected to the input port and the output port, while a secondary chain of serially connected inductors is connected to the coupled port and the ballasting port. A first compensation capacitor is connected to the input port and the coupled port, and a second compensation capacitor is connected to the input port and the ballasting port.

22 Claims, 21 Drawing Sheets

MINIATURE RADIO FREQUENCY DIRECTIONAL COUPLER FOR CELLULAR APPLICATIONS

CROSS-REFERENCE TO RELATED APPLICATIONS

This application relates to and claims the benefit of U.S. Provisional Application No. 61/811,455, filed Apr. 12, 2013 and entitled MINIATURE RADIO FREQUENCY DIRECTIONAL COUPLER FOR CELLULAR APPLICATIONS, which is wholly incorporated by reference herein.

STATEMENT RE: FEDERALLY SPONSORED RESEARCH/DEVELOPMENT

Not Applicable

BACKGROUND

1. Technical Field

The present disclosure relates to radio frequency (RF) circuit components, and more particularly, to a miniature RF directional coupler.

2. Related Art

Directional couplers are passive devices utilized to couple a part of the transmission power on one signal path to another signal path by a predefined amount. Conventionally, this is achieved by placing the two signal paths in close physical proximity to each other, such that the energy passing through one is passed to the other. This property is useful for a number of different applications, including power monitoring and control, testing and measurements, and so forth.

The directional coupler is a four-port device including an input port (P1), an output port (P2), a coupled port (P3), and an isolated or ballasting port (P4). The input power of RF signal supplied to P1 is coupled to P3 according to a coupling factor that defines the fraction of the input power that is passed to P3. The remainder of the power on P1 is delivered to P2, and in an ideal case, no power is delivered to P4. The degree to which the forward and backward waves are isolated is the directivity of the coupler, and again, in an ideal case, would be infinite. Directivity may also be defined as the difference between S31 (coupling coefficient) and S32 (reverse isolation). In an actual implementation, however, some level of the signal is passed to both to P3 and P4, though the addition of a ballasting resistor to P4 may be able to dissipate some of the power.

The type of transmission lines utilized in such conventional RF directional couplers includes coaxial lines, strip lines, and micro strip lines. The geometric dimensions are proportional to the wavelength of transmitted signal for a given coupling coefficient. Directional couplers utilizing lumped element components are known in the art, but such devices are also dimensionally large. These devices are implemented with ceramic substrates and thin-film printed metal traces, and have footprints of 2×1.6 mm and 1.6×0.8 mm and above, which is much larger than semiconductor die implementations. Notwithstanding the relatively large physical coupling area of the transmission lines, such directional couplers only have a directivity of around 10 dB. The resultant power control accuracy is approximately +/−0.45 dB. Such performance is unsuitable for many applications including mobile communications, where high voltage standing wave ratios (VSWR) at the antenna are possible.

Instead of lumped element circuits, directional couplers may be based on integrated passive devices (IPD) technology and implemented on wafer level chip scale packaging (WL-CSP). Due to the footprint restrictions, implementation of directional couplers on semiconductor dies is generally limited to microwave and millimeter wave operating frequencies. These types of directional couplers utilize two coupled inductors. Although suitable for on-die implementations, such couplers exhibit low levels of directivity due to the small geometric dimensions. With a mismatch on the output port (P2), the reflected signal may leak to the coupled port (P3) and mix with the originally coupled signal, thereby resulting in a high level of uncertainly in measurements of transferred power to the output port P2. Even with higher coupling coefficients possible with increasing the number of turns in interwound micro strip line coupled inductors, directivity remains low.

An improvement over the basic coupled inductor architecture is disclosed in U.S. Pat. No. 7,446,626. In addition to the coupled inductors, there is a compensation capacitor and a compensation resistor that are understood to provide a high level of directivity (around 60 db) notwithstanding the small geometry. With the use of low inductance values, low insertion loss resulted. However, there are several deficiencies with such earlier directional couplers. The lumped element capacitors utilized therein are only capable of sustaining a limited voltage level. In typical metal-insulator-metal (MIM) capacitors, the breakdown voltage ranges from 5V to 30V, depending on the particular semiconductor technology utilized. Conventional techniques for increasing capacitive density involve reducing the thickness of the dielectric between the metal plates to several hundred angstroms, and though the footprint is reduced, so is the breakdown voltage. The use of the aforementioned compensation resistor for achieving high directivity across a wide frequency range is also problematic in that a more expensive semiconductor process must be utilized. It is possible in some instances to exclude the compensation resistor, but this results in reduced directivity.

Further improvements to directional couplers are disclosed in U.S. patent application Ser. No. 13/333,706 entitled ON-DIE RADIO FREQUENCY DIRECTIONAL COUPLER filed on Dec. 21, 2011 and published as U.S. Pat. App. Pub. No. US 2012/0161898 on Jun. 28, 2012, the entirety of which is incorporated herein by reference. This disclosure utilizes two coupled inductors and two or three compensation capacitors. Utilization of compensation capacitors allows for high voltage operation of these couplers. This allowed for a relatively small size with reasonable performance. However, for cellular (WCDMA and the like) designs, it would be desirable to have a coupling coefficient of approximately 20 dB, which would result in a fairly large directional coupler and higher associated insertion loss if this design were followed.

Therefore, there is a need in the art for an improved RF directional coupler capable of being used in cellular applications with a high level of directivity and a miniaturized size in comparison to the prior art for reduced insertion loss.

BRIEF SUMMARY

In accordance with one embodiment of the present disclosure, there is contemplated a miniaturized directional coupler. As with any directional coupler there is an input port, an output port, a coupled port, and a ballasting port. The coupler further has a primary chain of inductors, as well as a secondary chain of inductors. Each chain of inductors includes a plurality of inductors connected serially. A first inductor of the primary chain of inductors is connected to the input port and a last inductor of the primary chain of inductors is connected to the output port, while a first inductor of the secondary chain of inductors is connected to the coupled port and a last inductor of the secondary chain of inductors is connected to the ballasting port. The directional coupler further includes a first compensation capacitor connected to the input port and the coupled port, as well as a second compensation capacitor connected to the input port and the ballasting port. The primary chain of inductors is inductively coupled to the secondary chain of inductors.

In certain embodiments, the primary chain of inductors may include two inductors (i.e., wherein a second inductor is the last inductor in the chain) and the secondary chain of inductors may also include two inductors (i.e., wherein a second inductor is the last inductor in the chain). When each chain includes two inductors, the arrangement of the inductors can take various configurations. For example, the physical arrangement of the inductors may be in an alternating pattern, such that it follows the order of the first primary chain inductor, the first secondary chain inductor, the second primary chain inductor, and the second secondary chain inductor. Alternatively, the physical arrangement of the inductors may be that the two primary chain inductors are located outside of the two secondary chain inductors, such that the arrangement follows the pattern of the first primary chain inductor, the first secondary chain inductor, the second secondary chain inductor, and the second primary chain inductor. Yet another configuration of the inductors may be such that the two primary chain inductors are located next to the two secondary chain inductors, so that the arrangement follows the pattern of the first primary chain inductor, the second primary chain inductor, the first secondary chain inductor, and the second secondary chain inductor.

The directional coupler may further include additional compensation capacitors. For example, the directional coupler may further include a third compensation capacitor connected to the input port and the first secondary chain inductor and/or a fourth compensation capacitor connected to the input port and the output port.

Another embodiment of the directional coupler is contemplated that further includes a dielectric layer, and wherein the inductors are spiral conductive traces. In this embodiment, the primary chain of inductors and secondary chain of inductors may be situated on different metal layers. This embodiment may further include a first primary underpath formed on the dielectric layer connecting the input port to a first primary chain spiral conductive trace. There may also be a second primary underpath formed on the dielectric layer connecting the first primary chain spiral conductive trace to a second primary chain spiral conductive trace. There may additionally be a first secondary underpath formed on the dielectric layer connecting the coupled port to a first secondary chain spiral conductive trace. Also, there may be a second secondary underpath formed on the dielectric layer connecting the first secondary chain spiral conductive trace to a second secondary chain spiral conductive trace.

The directional coupler may further include at least one capacitive stub connecting the primary chain to the secondary chain. The primary chain may have a first predefined width, while the secondary chain may have its own second predefined width. Further, the primary underpath may have a third predefined width, while the secondary underpath may have a fourth predefined width, and the primary chain may be separated from the secondary chain by a fifth predefined distance. In this regard, the first predefined width may be greater than the second predefined width. Also, the third predefined width may be greater than the first predefined width, while the fourth predefined width may be substantially equal to the second predefined width and the fifth predefined distance. In particular embodiments, the first predefined width may be approximately 5 μm, the second predefined width may be approximately 2.5 μm, the third predefined width may be approximately 20 μm, the fourth predefined width may be approximately 2.5 μm, and the fifth predefined distance may be approximately 2.5 μm. Further, the directional coupler may be be arranged in various configurations depending on the intended use. For example, the directional coupler may have a footprint area of approximately 105 μm by 85 μm when used in cellular high-band applications or a footprint area of approximately 130 μm by 110 μm when used in cellular low-band applications. These dimensions are particularly well suited, since they are in line with layout rules provided by different semiconductor foundries.

The dielectric layer can take various forms known within the art including, but not limited to, a semiconductor substrate, a low temperature co-fired ceramic (LTCC) substrate, and a thin-film printed substrate, as well as different types of laminate substrates. In order to inductively couple the primary chain of inductors with the secondary chain of inductors, the two chains may be disposed in a spaced, parallel relationship. In order to minimize the footprint of the directional coupler, the two chains may be arranged in a spiral configuration having a plurality of successively inward turns. The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

DETAILED DESCRIPTION

The detailed description set forth below in connection with the appended drawings is intended as a description of the presently preferred embodiments of a radio frequency (RF) directional coupler, and is not intended to represent the only form in which the present invention may be developed or utilized. The description sets forth the functions of the invention in connection with the illustrated embodiment. It is to be understood, however, that the same or equivalent functions may be accomplished by different embodiments that are also intended to be encompassed within the scope of the invention. It is further understood that the use of relational terms such as first and second and the like are used solely to distinguish one from another entity without necessarily requiring or implying any actual such relationship or order between such entities.

There are several performance objectives that are applicable to RF directional couplers, including high directivity, high power levels, low insertion loss, and low sensitivity to variations in other connected electrical components. Various embodiments of the present disclosure contemplate directional couplers that meet these objectives as explained in more detail below, and further have additional practical advantageous characteristics such as decreased size, and simplified, low-cost implementation, among others.

Figure 1:
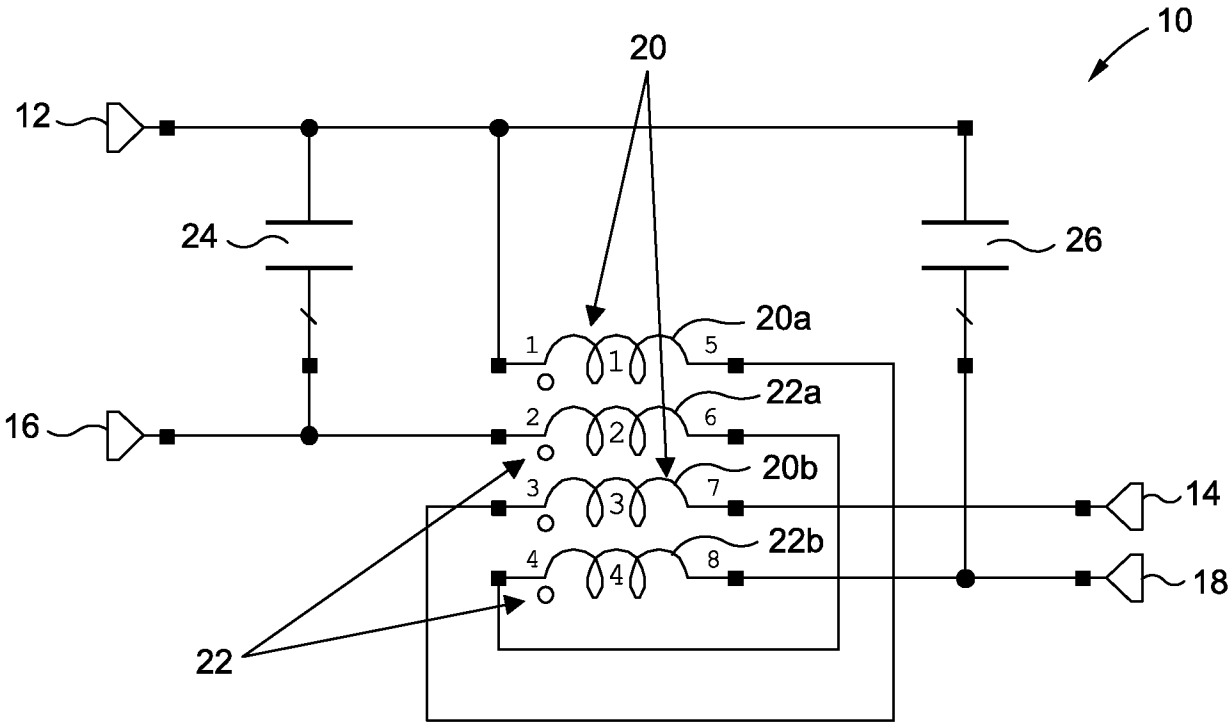
FIG. 1 is a schematic diagram illustrating a directional coupler in accordance with the present disclosure.

With reference to the schematic diagram of FIG. 1, one embodiment of such a directional coupler 10 has an input port 12, an output port 14, a coupled port 16, and a ballasting port 18. As described above, for a directional coupler in the general case, a portion of the signal that is applied to the input port 12 is passed through to the output port 14, and another portion of the same is passed to the coupled port 16. Although in an ideal case, the signal is not passed to the ballasting port 18, in a typical implementation, at least a minimal signal level is present. For purposes of discussing and graphically illustrating the scattering parameters (S-Parameters) of the four-port device that is the directional coupler 10, the input port 12 may be referred to as port P1, the output port 14 may be referred to as port P2, the coupled port 16 may be referred to as port P3, and the ballasting port 18 may be referred to as port P4. Each of the ports is understood to have a characteristic impedance of 50 Ohm for standard matching of components. However, depending on the case, the impedance can vary from the standard 50 Ohm.

Notwithstanding the foregoing naming conventions of the various ports of the directional coupler, it is possible to apply a signal to the port P3 (coupled port 16) that is passed to port P4 (ballasting port 18), with a portion thereof being passed to the port P1 (input port P12) and minimized at the port P2 (output port 14). In other words, the ports P1 and P2 are functionally reciprocal with the ports P3 and P4. It is understood, however, that directivity may be different between when the signal is applied to port P1 versus when the signal is applied to port P3. Although not entirely symmetric, in both cases there is contemplated to be sufficient directivity for most applications. Along these lines, the port P2 can be utilized as the input port while port P1 can be utilized as the output port. According to such use, it follows that the port P4 is the coupled port and the port P3 is the ballasting port. Another configuration where the port P4 is utilized as the input port, then the output port will be the port P3, while the port P2 will be the coupled port and the port P1 will be the ballasting port. The loss between port P1 and port P2, and the loss between port P3 and port P4 may be different if the widths and thicknesses of the conductive traces of the directional coupler 10, discussed in greater detail below, are different.

The directional coupler 10 further includes a primary chain of inductors 20 coupled to a secondary chain of inductors 22. Each chain of inductors 20, 22 is comprised of a plurality of inductors 20*a*, 20*b*, 22*a*, 22*b* connected serially. The first primary chain inductor 20*a* is connected to the input port 12 and to the second primary chain inductor 20*b*, while the second primary chain inductor 20*b* is further connected to the output port 14. The first secondary chain inductor 22*a* is connected to the coupled port 16 and to the second secondary chain inductor 22*b*, while the second secondary chain inductor 22*b* is further connected to the ballasting port 18.

Figure 2:
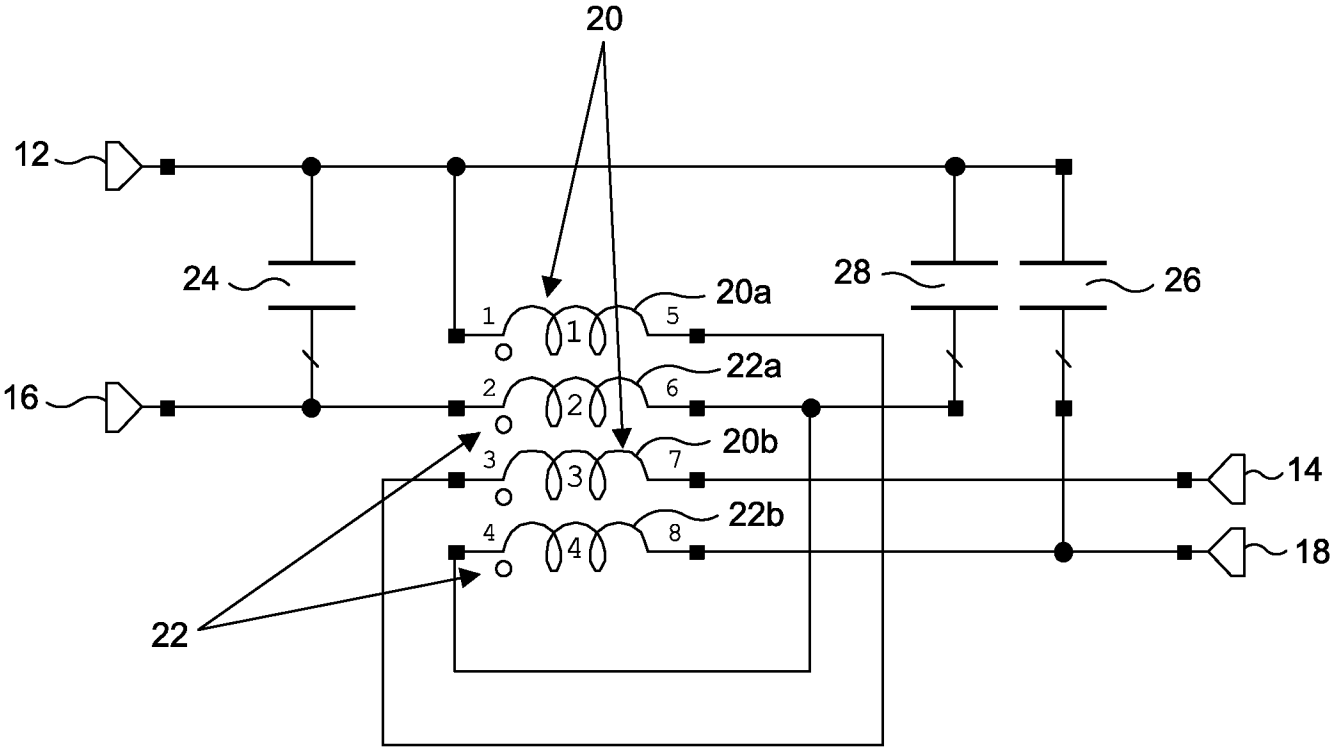
FIG. 2 is a schematic diagram illustrating a second embodiment of the directional coupler.
Figure 3:
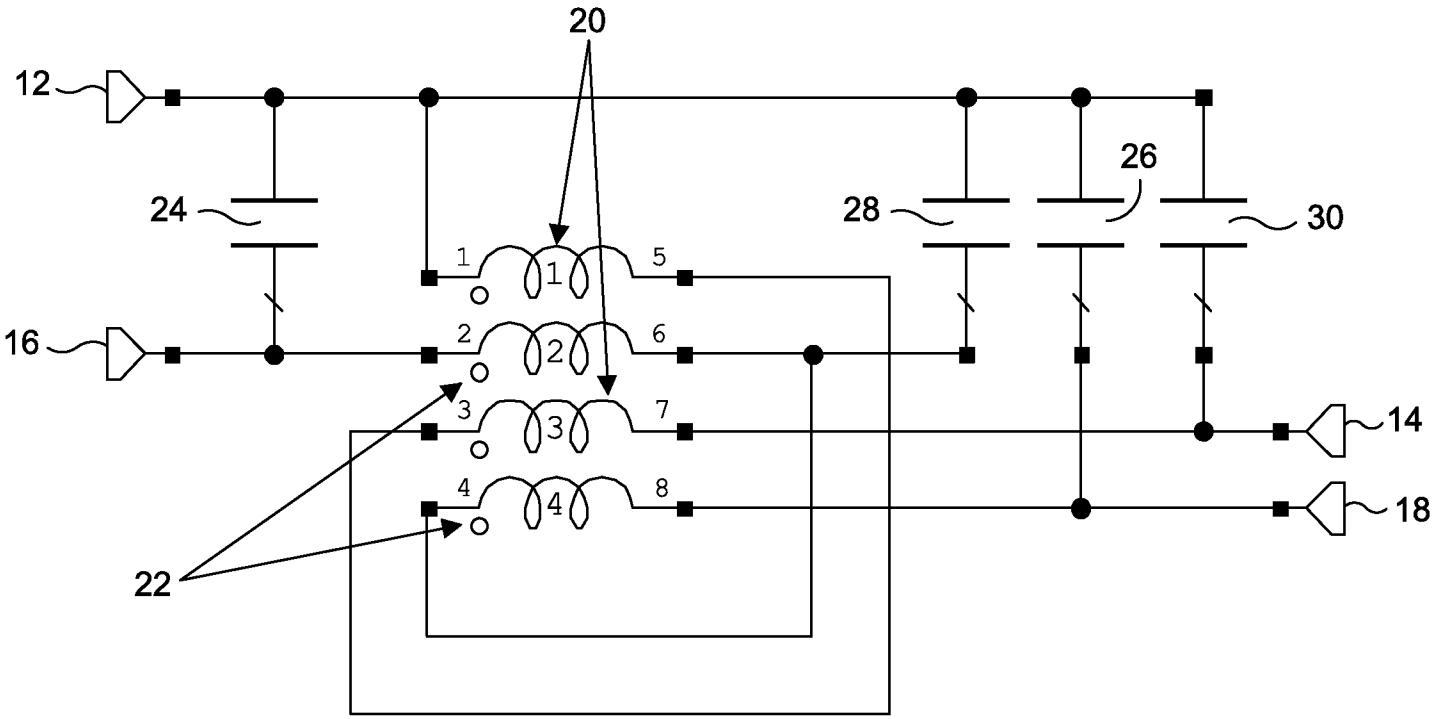
FIG. 3 is a schematic diagram illustrating a third embodiment of the directional coupler.

In accordance with various embodiments of the present disclosure, the directional coupler 10 includes a first compensation capacitor 24 that is connected to the input port 12 and the coupled port 16, in addition to a second compensation capacitor 26 that is connected to the input port 12 and the ballasting port 18. As shown in FIG. 2, the directional coupler 10 may further include a third compensation capacitor 28 that is connected to the input port 12 and the first secondary chain inductor 22*a*. As shown in FIG. 3, the directional coupler may further include a fourth compensation capacitor 30 that is connected to the input port 12 and the output port 14. The addition of third and fourth compensation capacitors allows for fine tuning of directivity at different frequencies.

While the primary chain inductors 20*a*, 20*b* are connected serially to each other, as the secondary chain inductors 22*a*, 22*b* are likewise connected serially to each other, the four inductors 20*a*, 20*b*, 22*a*, 22*b* may be arranged in various configurations to maximize the coupling between any particular inductors. For example, as shown in FIGS. 1-3, the physical arrangement of the inductors may consist of an alternating pattern between the primary chain 20 and the secondary chain 22. That is, the inductors shown in these figures are arranged in a configuration following the pattern of: first primary chain inductor 20*a*, first secondary chain inductor 22*a*, second primary chain inductor 20*b*, and second secondary chain inductor 22*b*. By arranging the inductors in this manner, a large coupling is created between the two primary chain inductors 20*a*, 20*b* and the first secondary chain inductor 22*a*. The second secondary chain inductor 22*b* is also coupled to the first primary chain inductor 20*a* and has increased coupling with the second primary chain inductor 20*b*. This embodiment of the present disclosure provides for substantially higher levels of coupling between the primary chain inductors 20 and the secondary chain inductors 22 for the same footprint area, in contrast to prior art directional couplers. In other words, for the same coupling coefficient utilizing the present disclosure, in comparison to prior directional couplers, a shorter geometric length of the coupled inductors results in decreased loss that could not otherwise be achieved.

Figure 4:
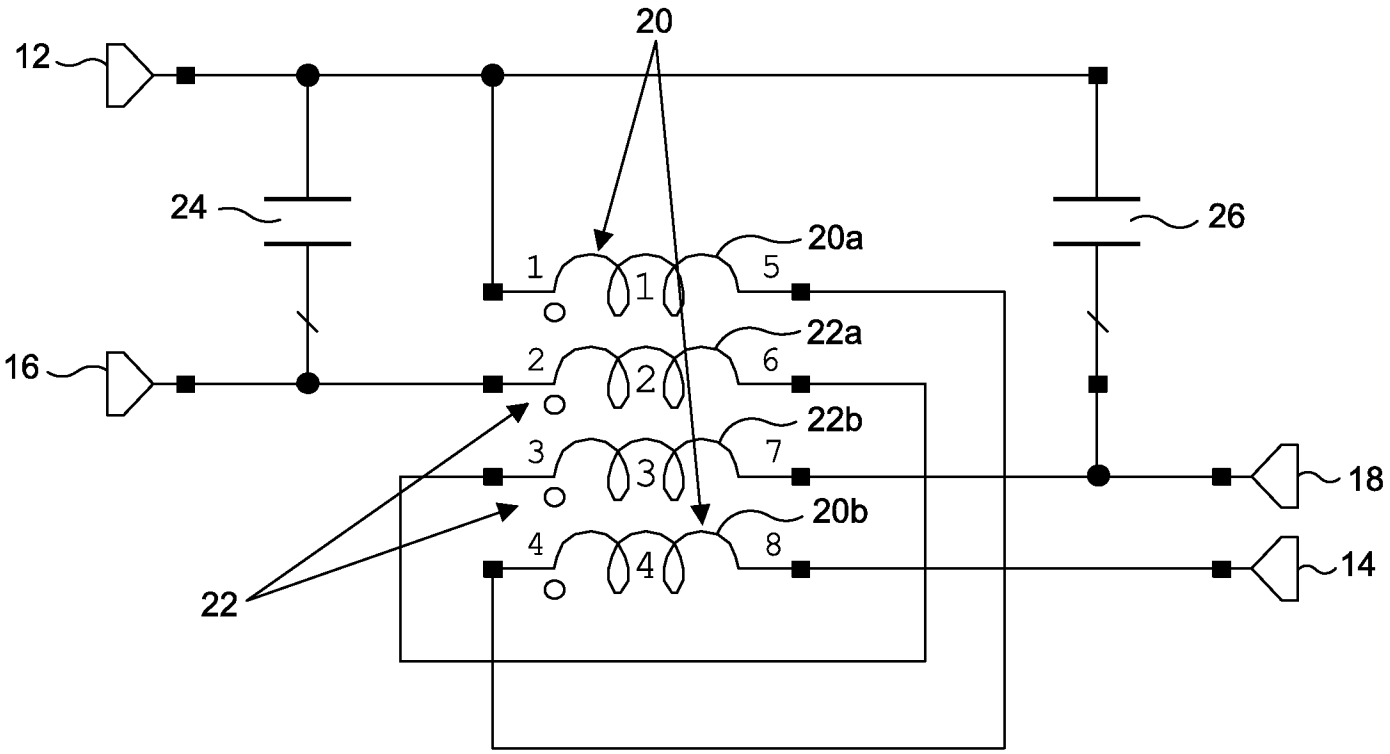
FIG. 4 is a schematic diagram illustrating a fourth embodiment of the directional coupler.

FIG. 4 illustrates another potential arrangement of the inductors. In particular, in this embodiment, the two primary chain inductors 20*a*, 20*b* are arranged outside of the two secondary chain inductors 22*a*, 22*b*. That is, the pattern is as follows: first primary chain inductor 20*a*, first secondary chain inductor 22*a*, second secondary chain inductor 22*b*, second primary chain inductor 20*b*. By arranging the inductors in this manner, a large coupling is created between the two secondary chain inductors 22*a*, 22*b*, while they both also have increased coupling with the two primary chain inductors

20*a*, 20*b*. This arrangement can similarly include the third capacitor 28 and/or fourth capacitor 30 as described above.

Figure 5:
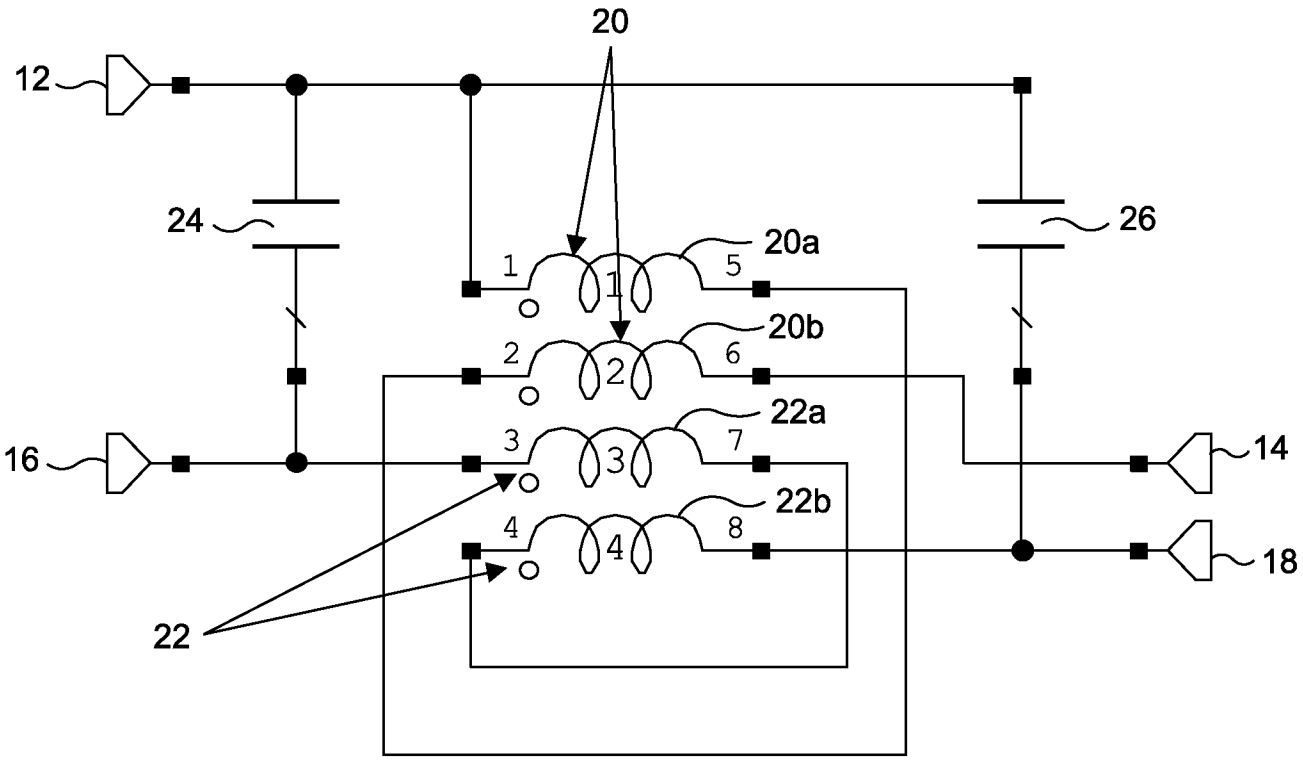
FIG. 5 is a schematic diagram illustrating a fifth embodiment of the directional coupler.

FIG. 5 illustrates yet another potential arrangement of the inductors. In particular, in this embodiment, the two primary chain inductors 20*a*, 20*b* are located next to the two secondary chain inductors 22*a*, 22*b*. That is, the pattern is as follows: first primary chain inductor 20*a*, second primary chain inductor 20*b*, first secondary chain inductor 22*a*, second secondary chain inductor 22*b*. By arranging the inductors in this fashion, a large coupling is created between the two secondary chain inductors 22*a*, 22*b* and a large coupling is created between the two primary chain inductors 20*a*, 20*b*. Additionally, both secondary inductors 22*a*, 22*b* have increased coupling with both primary inductors 20*a*, 20*b*. Again, this arrangement can similarly include the third capacitor 28 and/or fourth capacitor 30 as described above.

Figure 6:
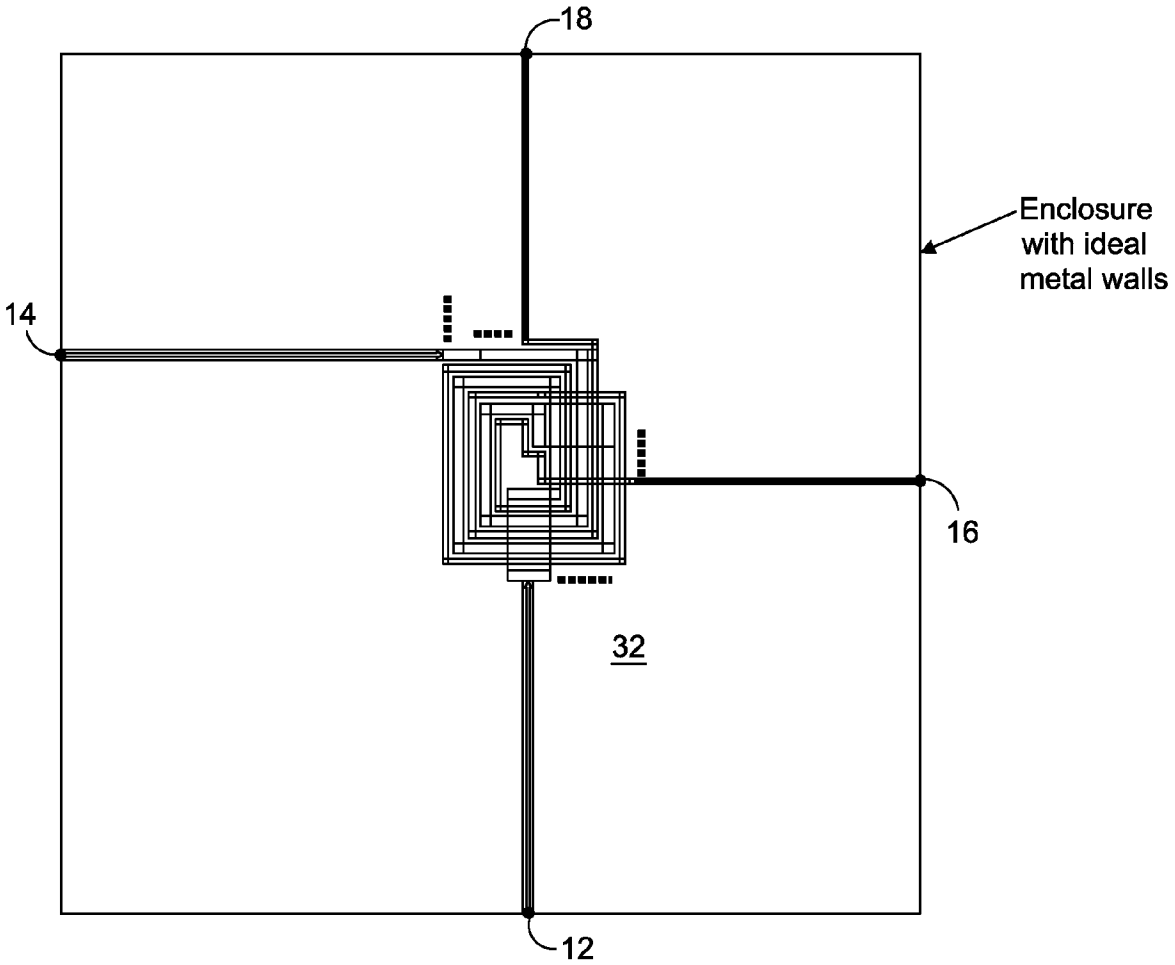
FIG. 6 is a plan view of the first embodiment of the directional coupler shown in FIG. 1 for cellular high band applications.

FIGS. 6-9 show a directional coupler which implements the various components discussed above as conductive traces with a particular geometry, size, and overall footprint. In particular, this arrangement is optimized for cellular high-band applications Like the schematic-level depiction, the directional coupler includes the input port 12, the output port 14, the coupled port 16, and the ballasting port 18. Each of these ports is understood to be the ends of respective connective traces that may be connection points from another component. Thus, the term port may refer to any conductive element that serves as an interface of the directional coupler 10 to outside electrical component connections. FIG. 6 presents an enclosure with ideal metal walls typically used in electromagnetic simulations of the structure. Further, simulation reference planes are shown by dashed lines.

Conductive elements of the directional coupler 10 are disposed on a dielectric layer 32, which may be a part of a semiconductor substrate. Alternative substrate materials such as low temperature co-fired ceramic (LTCC) and thin-film printed substrates are also possible. Those having ordinary skill in the art will recognize that the directional couplers 10 may be fabricated on any suitable dielectric material upon which a conductive path may be disposed. Along these lines, the conductive path may be formed of any electrically conductive material such as metal.

Figure 7:
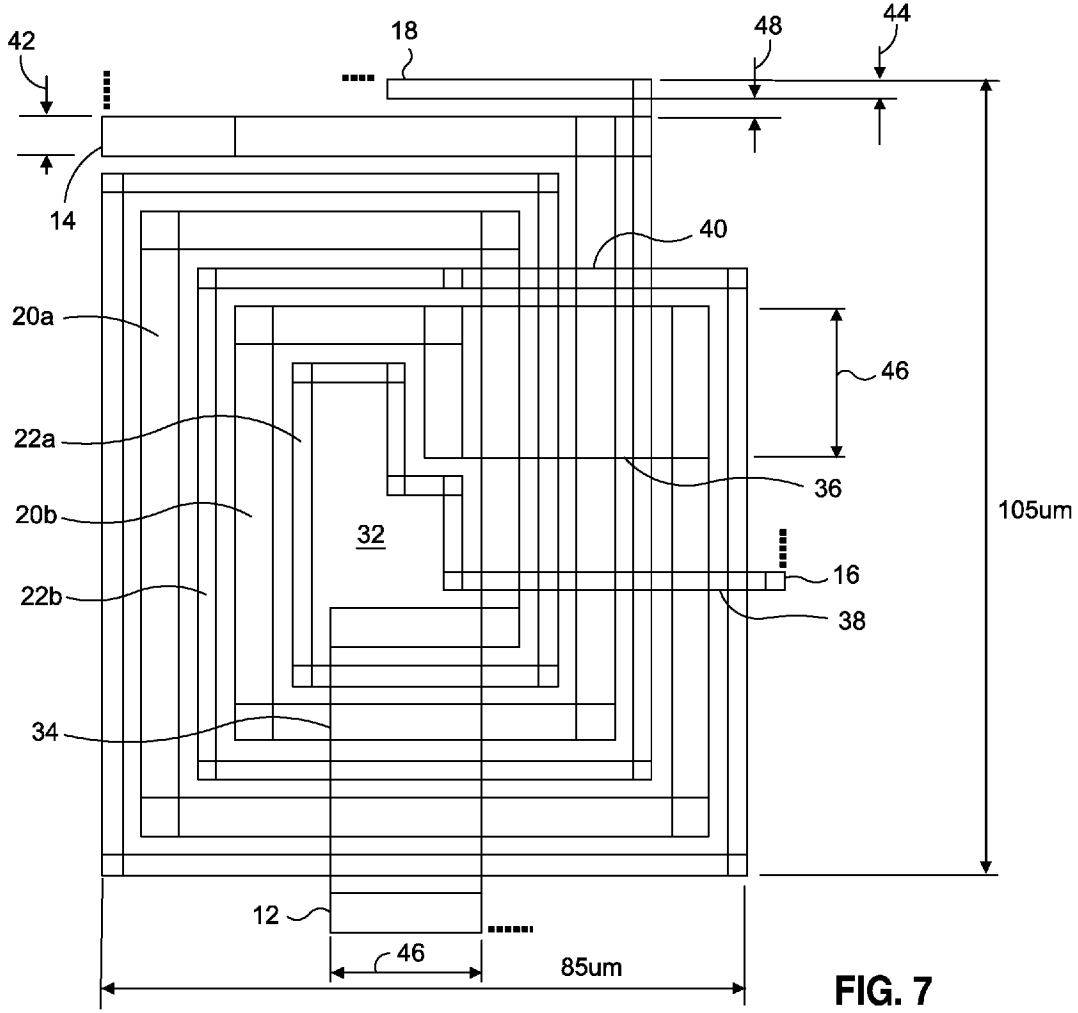
FIG. 7 is a detailed top plan view of the first embodiment of the directional coupler shown in FIG. 6.
Figure 8A:
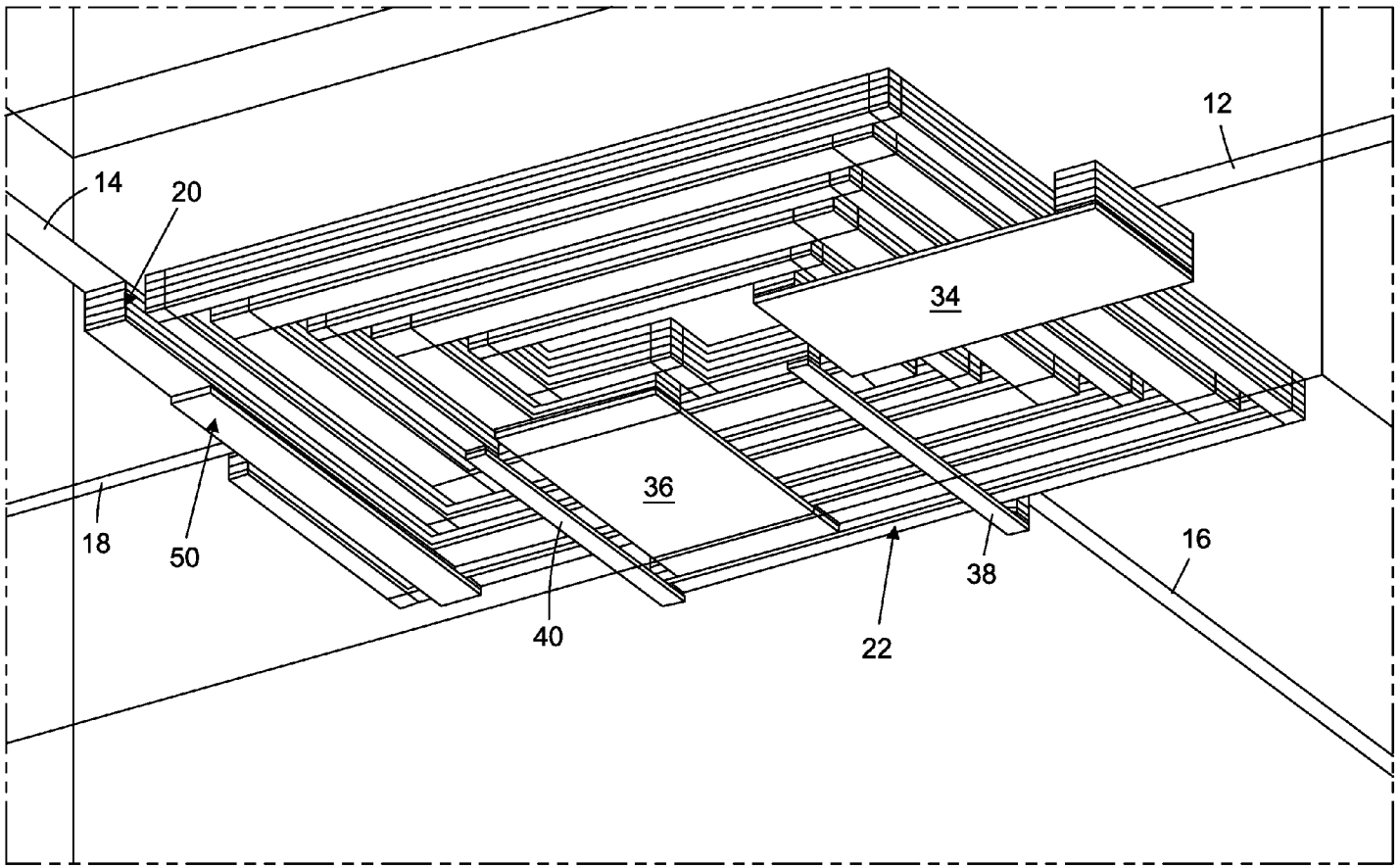
FIGS. 8A-8D are perspective views of the first embodiment of the directional coupler shown in FIG. 6.
Figure 8B:
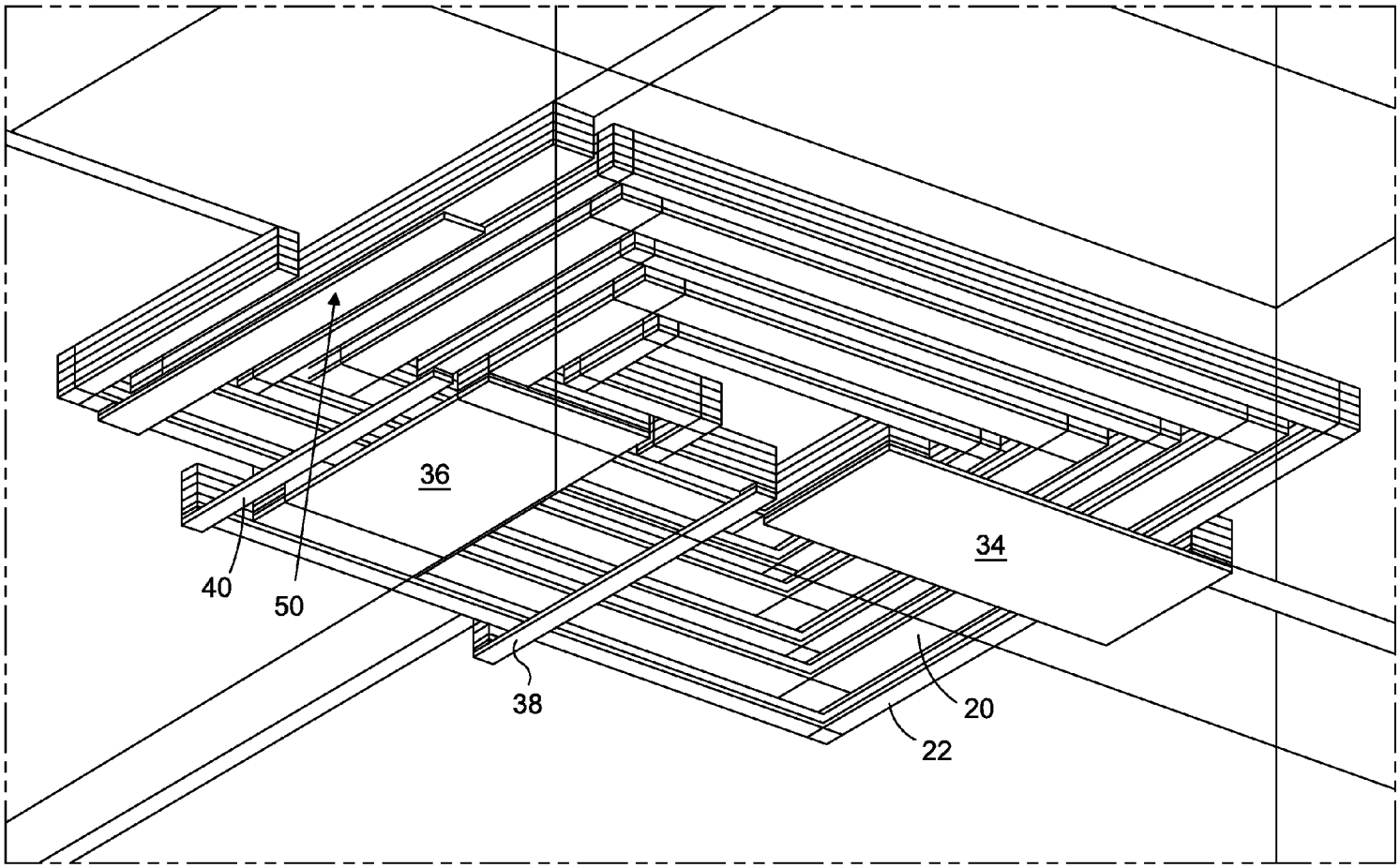
Figure 8C:
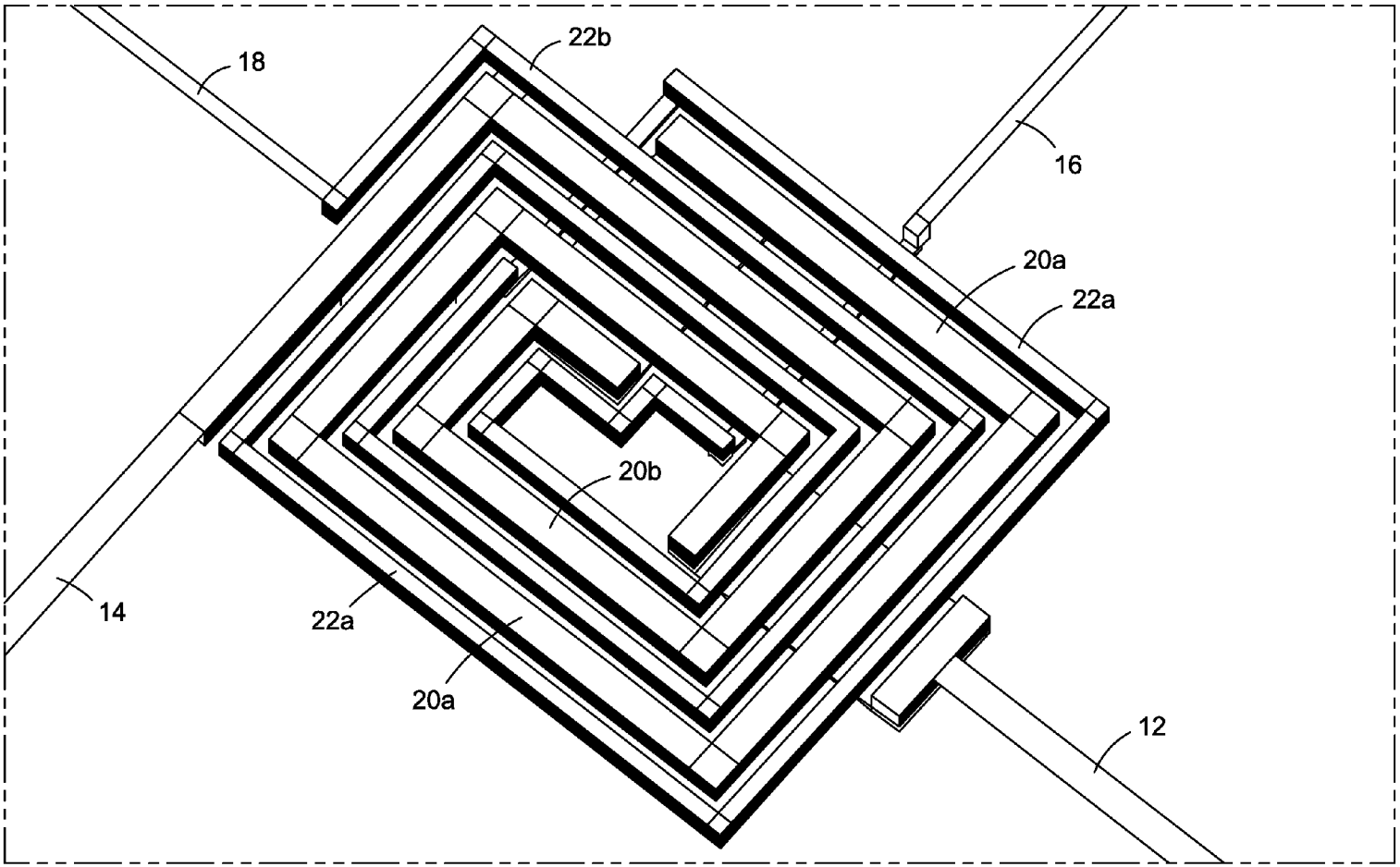
Figure 8D:
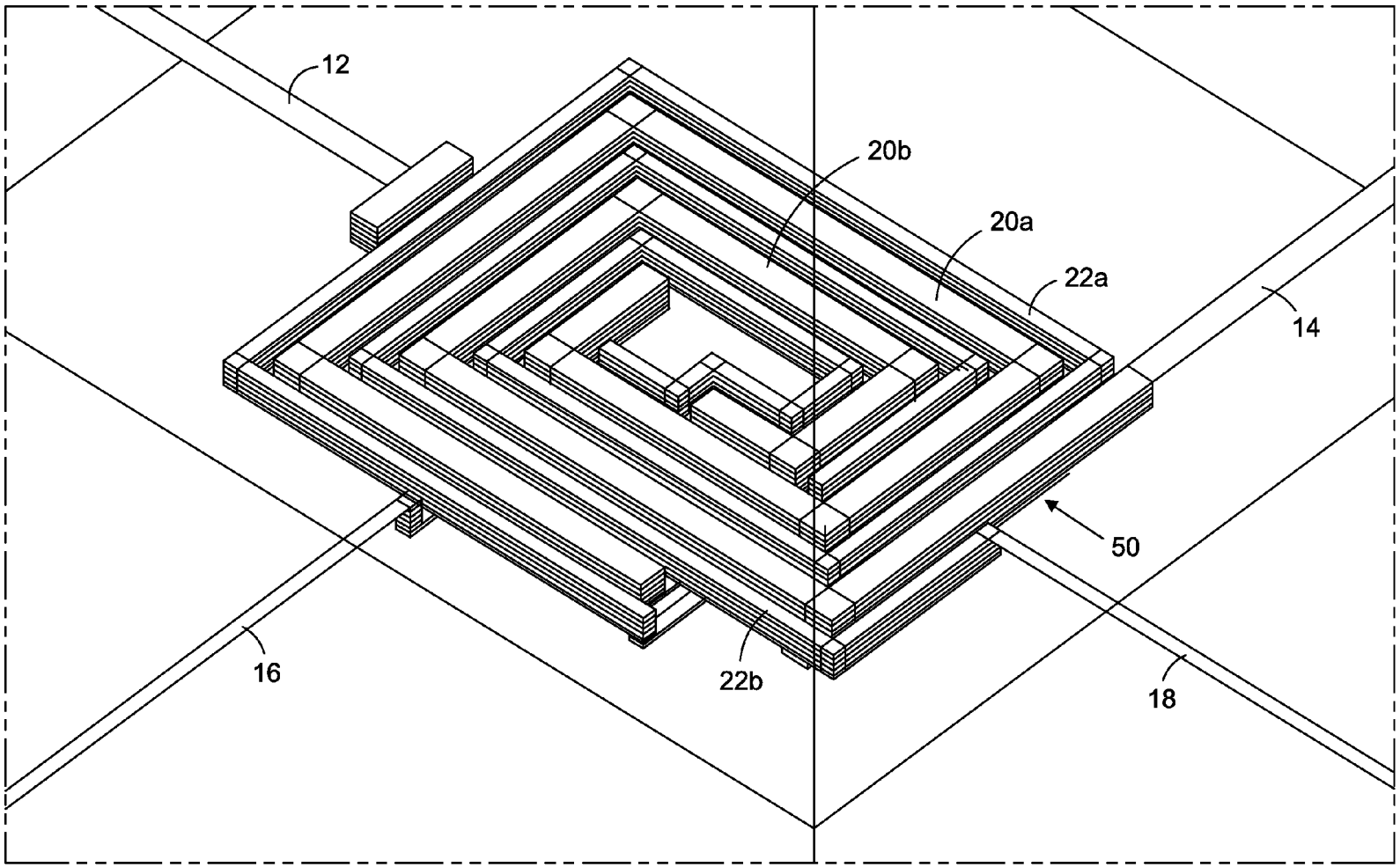

As best seen in FIG. 7, the directional coupler 10 includes a first primary chain spiral conductive trace 20*a* and a second primary chain spiral conductive trace 20*b* defined by relatively wide traces. In this regard, it is intended for the primary chain traces 20 to be dedicated to the main RF signal path. Although depicted and described in terms of specific perpendicular turns, it will be recognized that the spiral conductive traces described herein may instead be defined by a plurality of oblique angle turns, or circular turns, or another otherwise spiral configuration.

In order to connect the input port 12 to the first primary chain spiral conductive trace 20*a*, the directional coupler 10 includes a first primary underpath 34 formed on the dielectric layer 32. There is also a second primary underpath 36 formed on the dielectric layer 32 and connecting the first primary chain spiral conductive trace 20*a* to the second primary chain spiral conductive trace 20*b*. The second primary chain spiral conductive trace 20*b* then terminates in the output port 14.

The directional coupler 10 further includes a first secondary chain spiral conductive trace 22*a* and a second secondary chain spiral conductive trace 22*b* defined by relatively narrow traces. In order to connect the coupled port 16 to the first secondary chain spiral conductive trace 22*a*, the directional coupler 10 includes a first secondary underpath 38 formed on the dielectric layer 32. There is also a second secondary underpath 40 formed on the dielectric layer 32 and connecting the first secondary chain spiral conductive trace 22*a* to the second secondary chain spiral conductive trace 22*b*. The second secondary chain spiral conductive trace 22*b* then terminates in the ballasting port 18. The secondary chain spiral conductive traces 22 are disposed on the dielectric layer 32 in an interlocking, spaced coplanar relationship with the primary chain spiral conductive traces 20, and are inductively coupled thereto. In this embodiment the primary chain traces 20 and the secondary chain traces 22 are located in a single horizontal plane, while the underpaths 34, 36, 38, 40 are positioned in a different second horizontal plane. Both planes are separated by a dielectric layer 32 having a particular thickness.

Throughout their entire length, the primary chain spiral conductive traces 20 define a first width 42. In accordance with one embodiment of the present disclosure, the first width 42 is 5 μm. Also throughout their entire length, the secondary chain spiral conductive traces 22 define a second width 44. Relative to the first width 42, the second width 44 is narrower, for example, at 2.5 μm. It is understood that the secondary chain spiral conductive traces 22 are dedicated for the coupled RF signal path, and accordingly the signal level is lower, thus a narrower conductor is utilized. Additionally, the primary underpaths 34, 36 define a third width 46. It is contemplated that this third width 46 is wider than the first width to reduce insertion loss and to introduce additional capacitive coupling between the primary and secondary chains 20, 22. In one exemplary embodiment, the third width is 20 μm. As this is unnecessary for the secondary underpaths 38, 40, while they define a fourth width, it is contemplated to be equal or approximately equal to the second width 44. The spacing between any given point on the secondary chain spiral conductive trace 22 and the primary chain spiral conductive trace 20 is a constant fifth width 48, so the shape and configuration of the secondary chain spiral conductive trace 22 is similar to that of the primary chain spiral conductive trace 20. In one exemplary embodiment, the fifth distance 48 is 2.5 μm. Together with the primary chain spiral conductive traces 20 and the secondary chain spiral conductive traces 22, the overall dimensions in the exemplary embodiment shown in FIGS. 6-9 is 105 μm×85 μm. In general, the closer metal traces are positioned to each other, the higher the level of magnetic and electrical coupling is between them. The placement of the traces may be limited by the particular technology utilized.

Similar to that described above, FIGS. 10-13 illustrate an embodiment optimized for cellular low-band applications. In this configuration, the primary chain spiral conductive traces 20 and the secondary chain spiral conductive traces 22 comprise an overall dimension of 130 μm×110 μm. It should be noted that FIGS. 8 and 12 present metal traces "stacked" with several metals for simulation purposes only. The total thickness of the metal traces is defined by the particular fabrication process utilized.

According to another aspect of the present disclosure, the directional coupler 10 may further include one or more conductive circuit elements disposed on the dielectric layer 32 for increasing the capacitive coupling of the primary chain spiral conductive traces 20 to the secondary chain spiral conductive traces 22. In this regard, the conductive circuit elements may be capacitive stubs 50 that capacitively connect the primary chain 20 to the secondary chain 22. The conductive capacitive stubs 50 may be electrically connected to either the primary chain traces 20 or to the secondary chain traces 22. Adjustments in the length and width of the capacitive stub(s) 50, as well as the physical point of their electrical connection to a particular chain, allow for the maximum level of directivity at proper frequencies.

Figure 9:
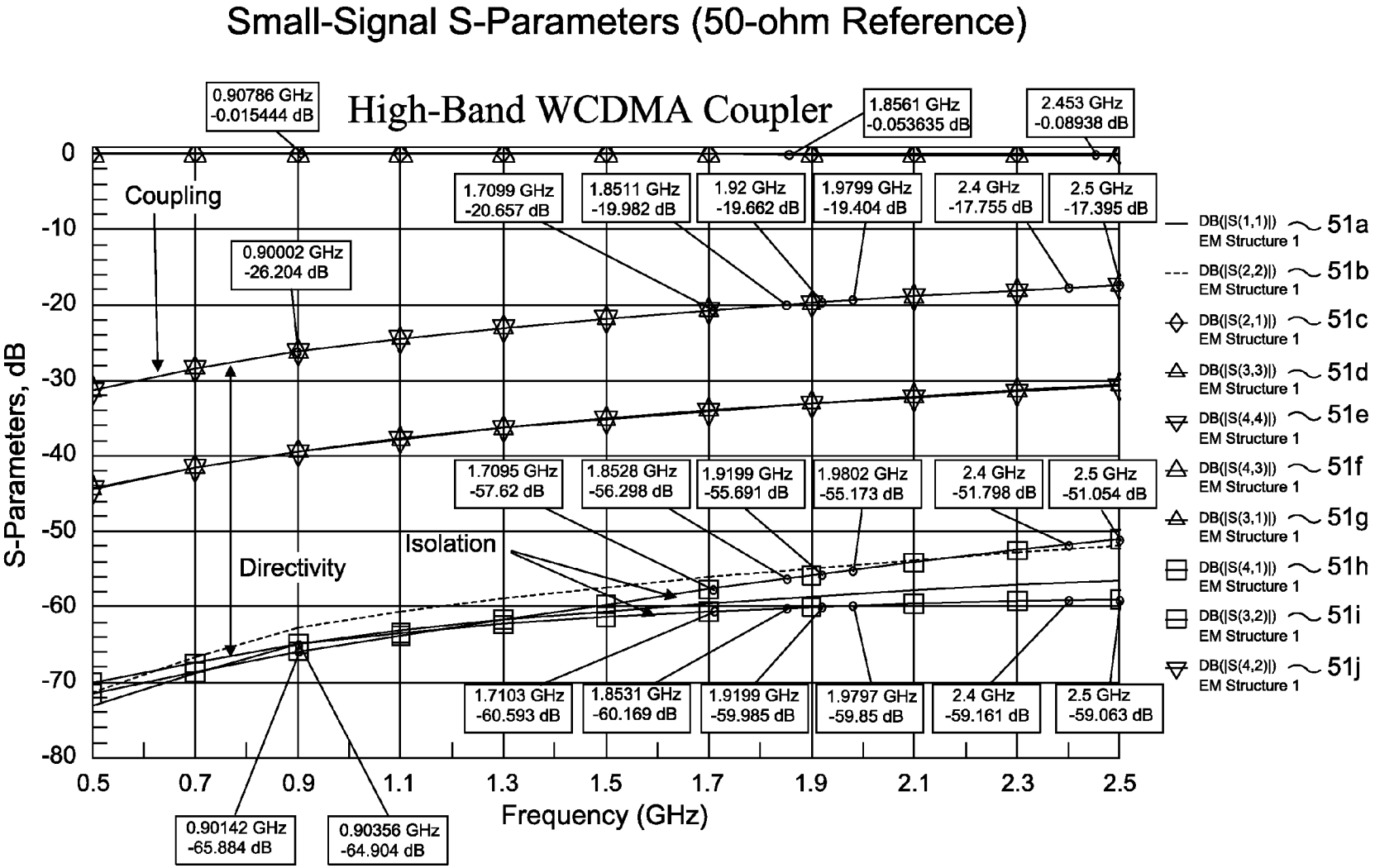
FIG. 9 is a graph showing the scattering parameters (S-parameters) of the directional coupler shown in FIG. 6.
Figure 10:
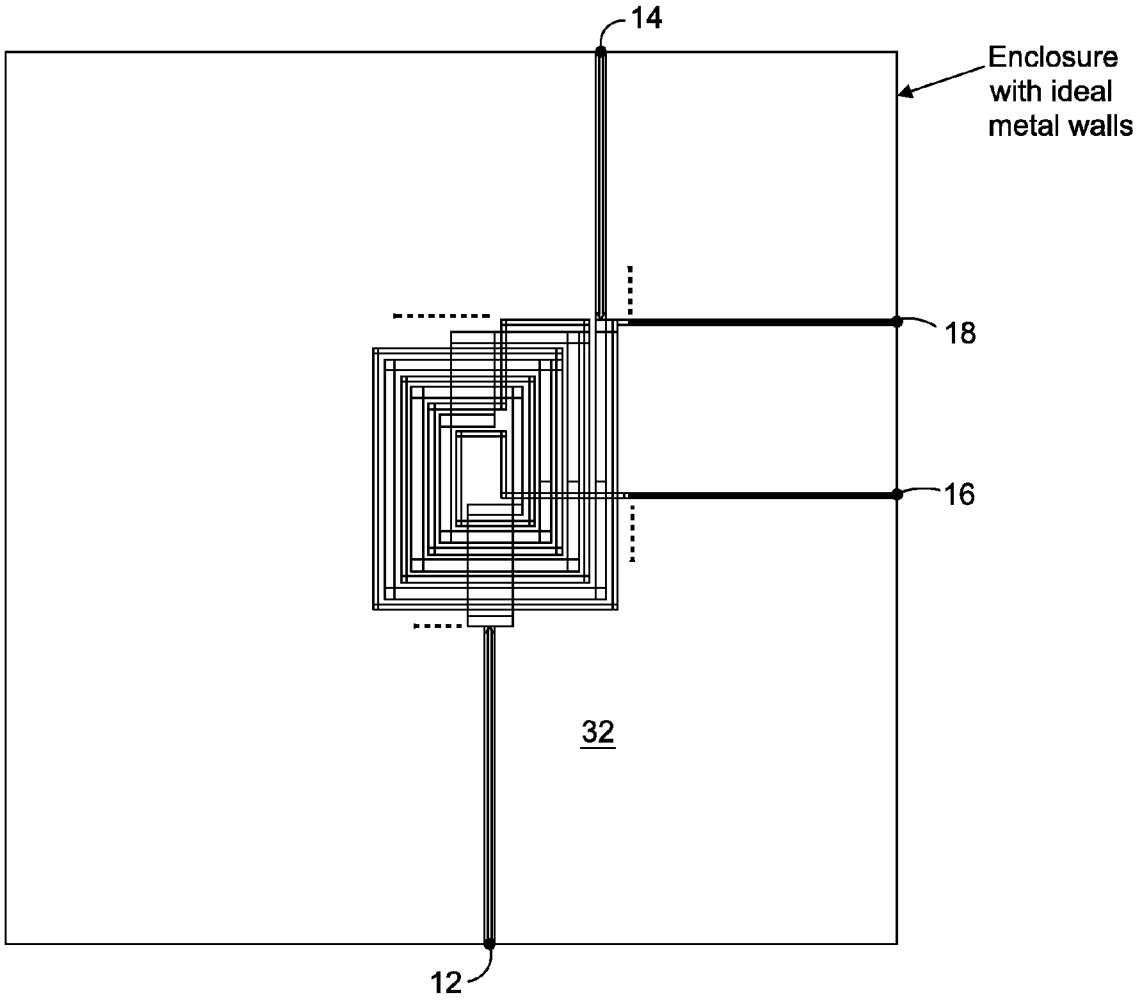
FIG. 10 is a plan view of the first embodiment of the directional coupler shown in FIG. 1 for cellular low-band applications.
Figure 11:
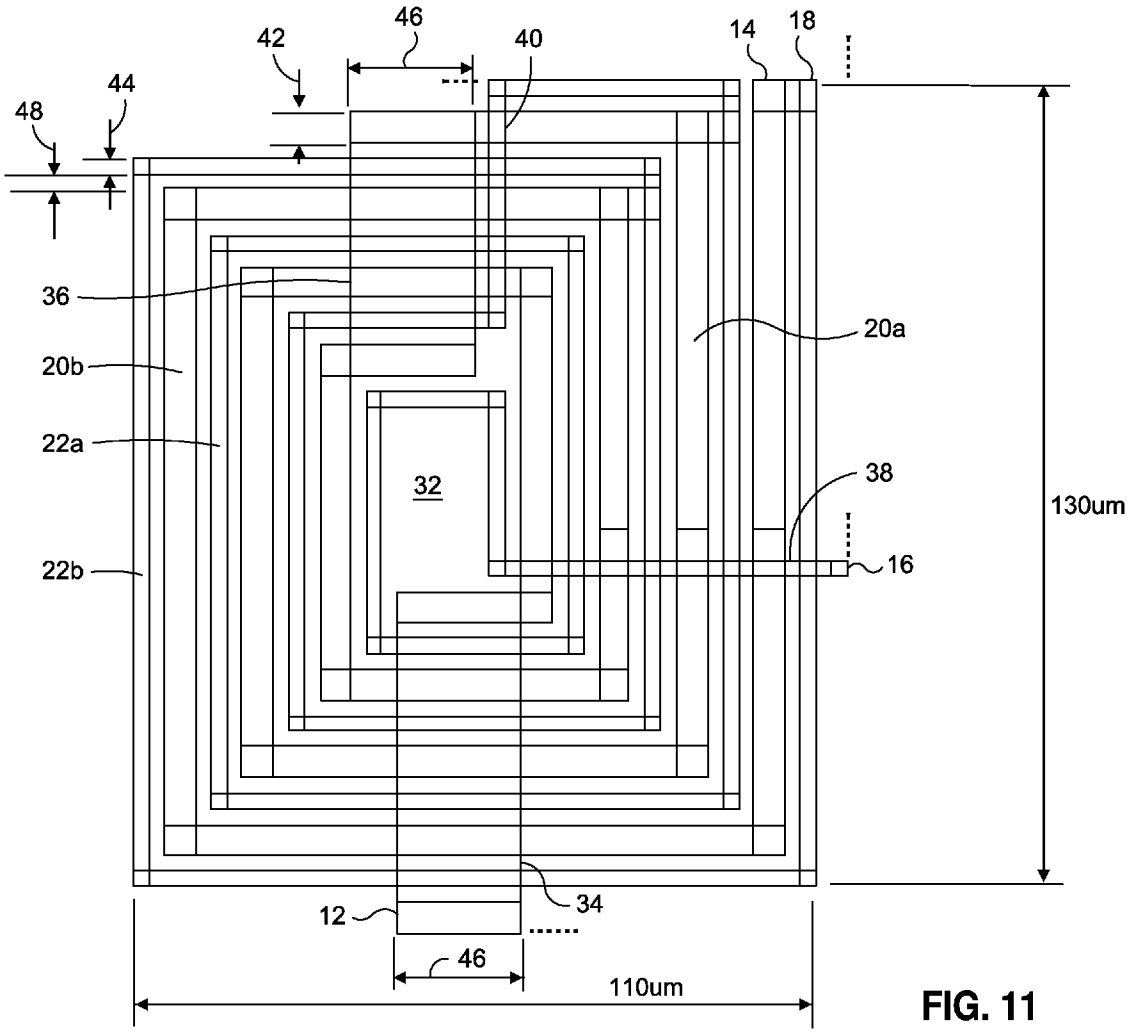
FIG. 11 is a detailed top plan view of the first embodiment of the directional coupler shown in FIG. 10.
Figure 12A:
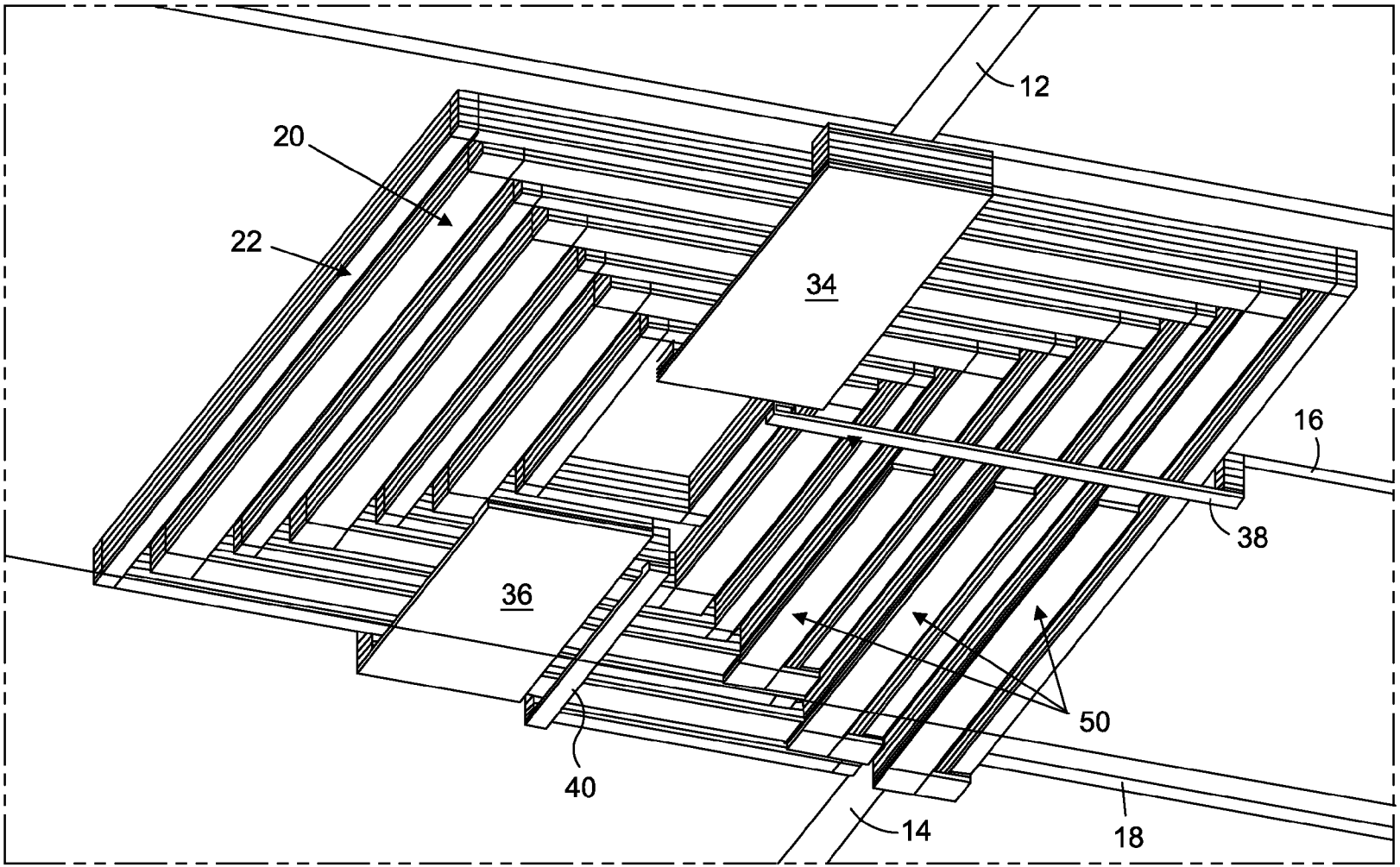
FIGS. 12A-12D are perspective views of the first embodiment of the directional coupler shown in FIG. 10.
Figure 12B:
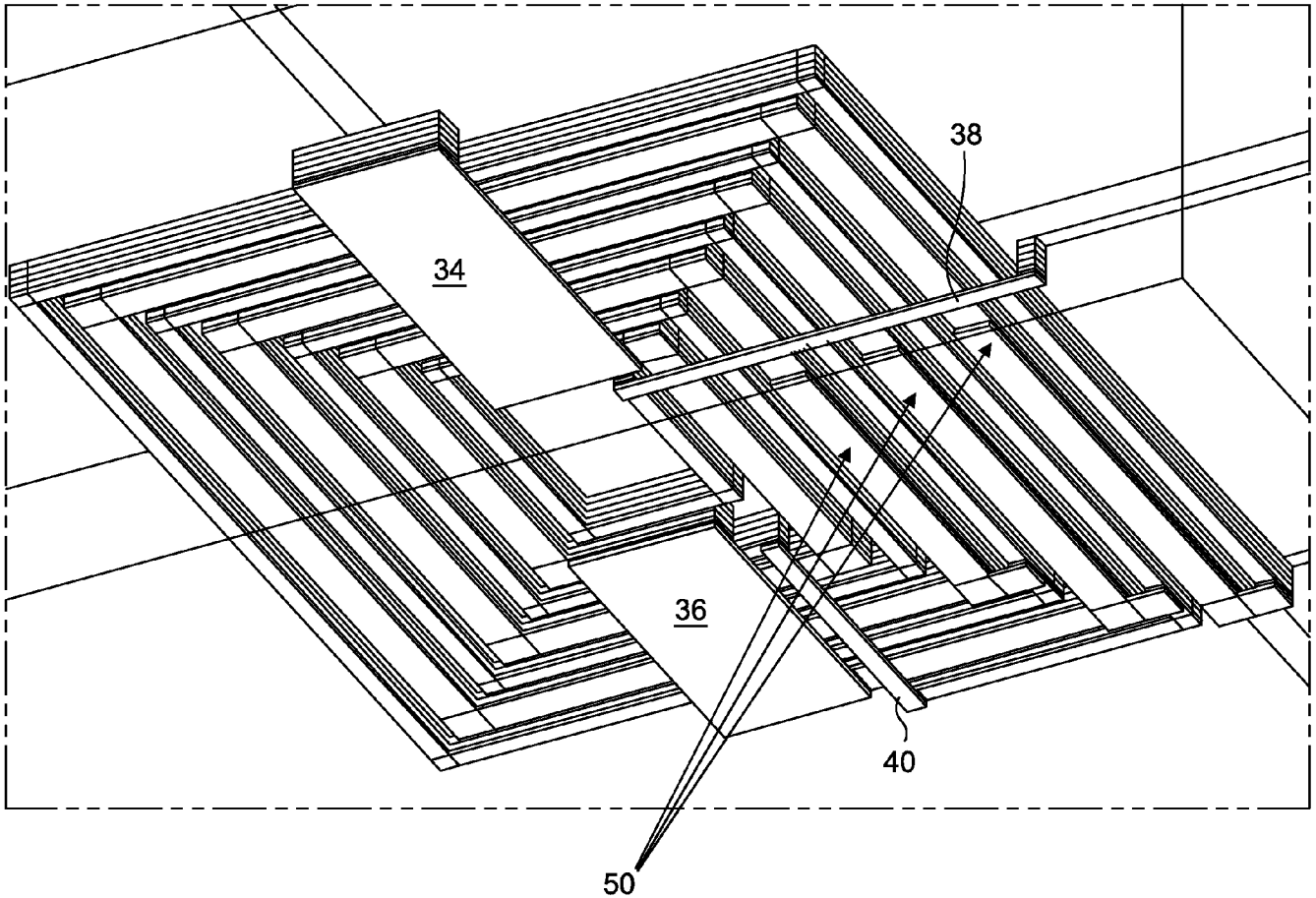
Figure 12C:
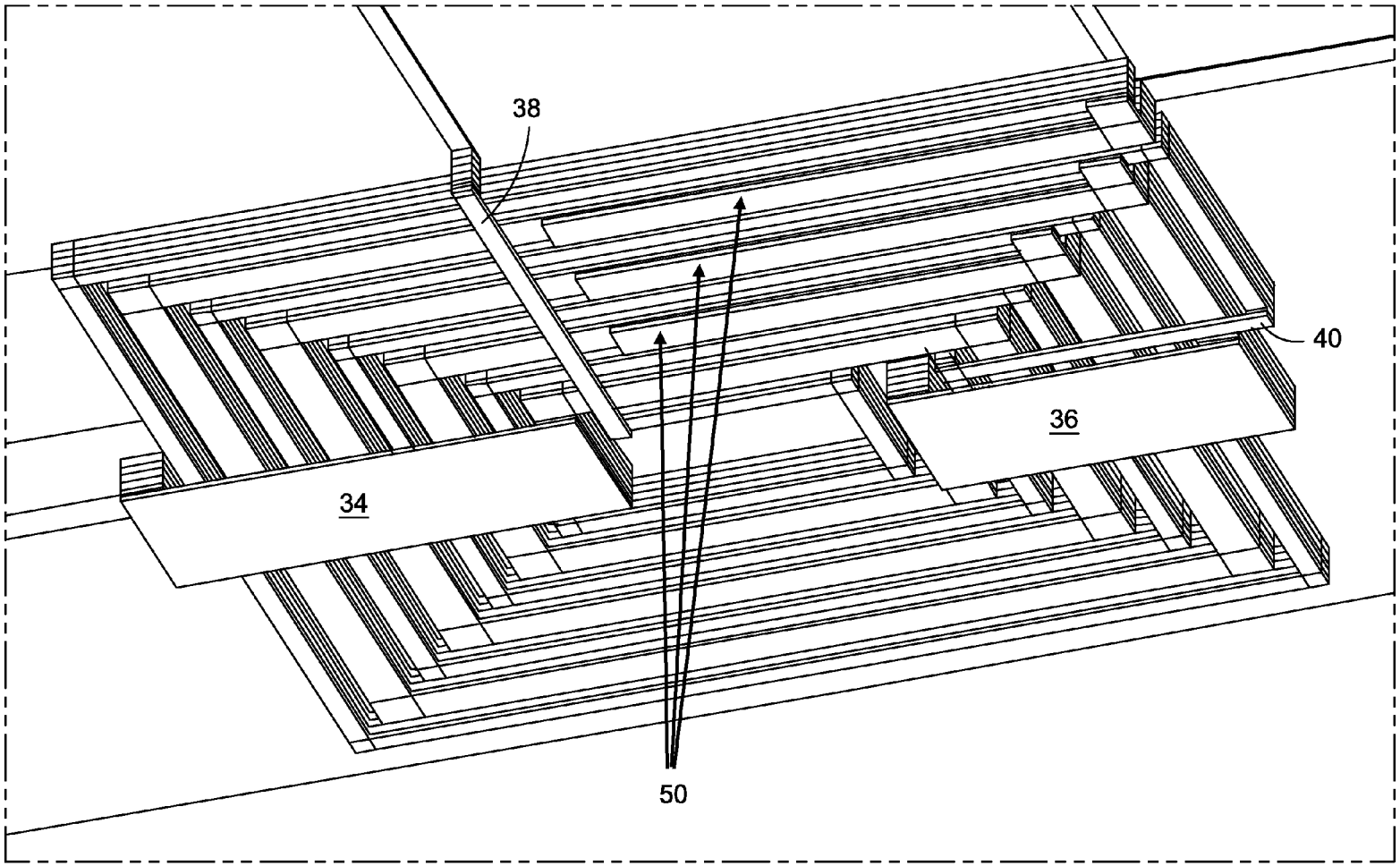
Figure 12D:
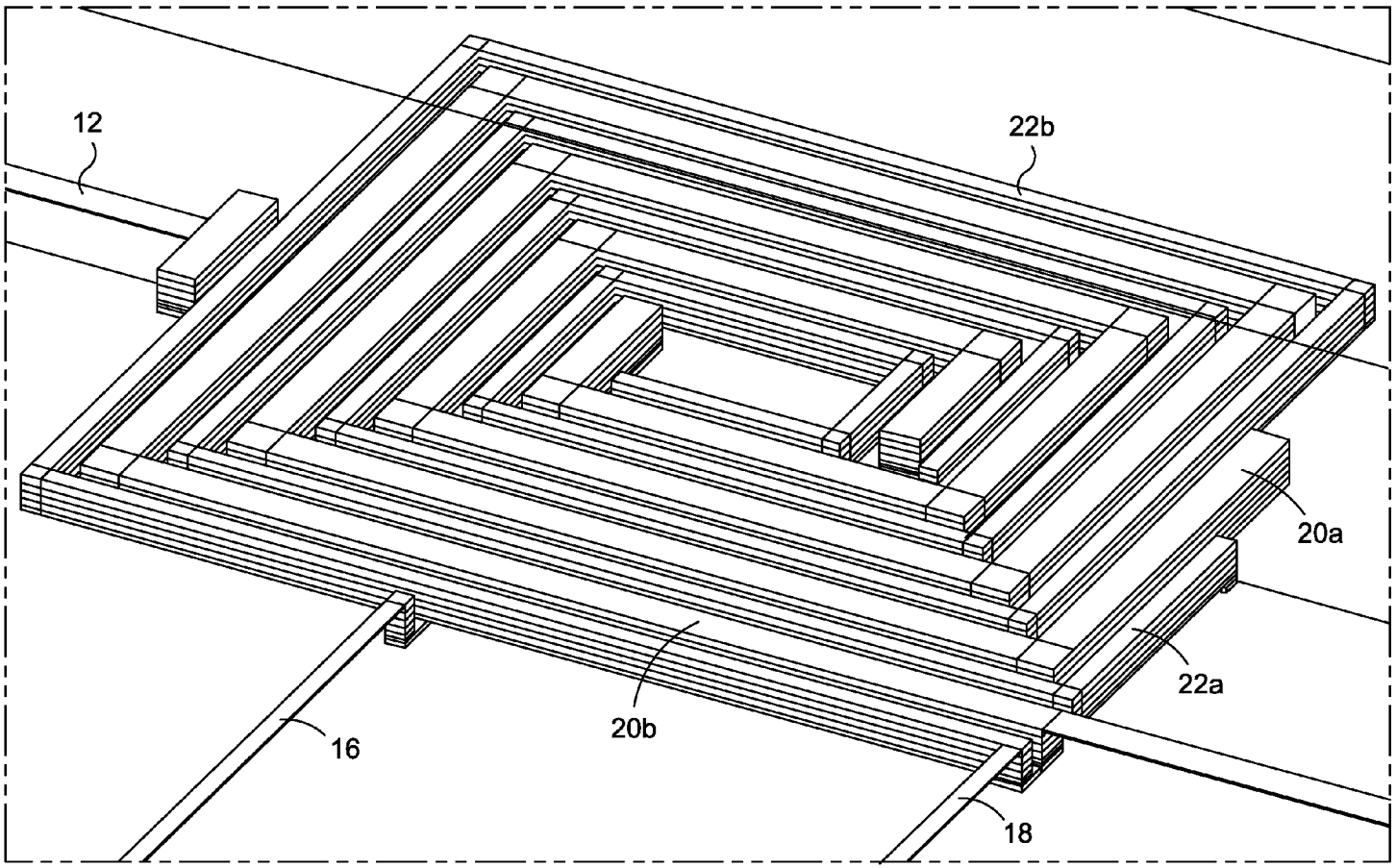

With reference to the graph of FIG. 9, given the four-port configuration of the directional coupler 10, the electrical behavior thereof in response to a steady-state input can be described by a set of scattering parameters (S-parameters). As pertinent to the operational characteristics of the directional coupler 10, the primary chain 20 and the secondary chain 22 may be characterized by a predefined coupling factor, that is, the degree to which the signal on the primary chain 20 is passed or coupled to the secondary chain 22. The coupling factor corresponds to S31, or the gain coefficient between the input port 12 (P1) and the coupled port 16 (P3). This is shown in a seventh plot 51*g*. Additionally, the coupled inductor chains 20, 22 are also characterized by a predefined first isolation factor between the input port 12 and the coupled port 16. The first isolation factor corresponds to S32 shown as a ninth plot 51*i*, and is the gain coefficient between the output port 14 (P2) and the coupled port 16 (P3). The coupled inductor chains 20, 22 are further characterized by a predefined second isolation factor between the input port 12 and the ballasting port 18. The predefined second isolation factor corresponds to S41 shown as an eighth plot 51*h*, and is the gain coefficient between the input port 12 (P1) and the ballasting port 18 (P4). The remainder of the plots of the graph shown in FIG. 9 includes a first plot 51*a* describing the input port reflection coefficient S11, a second plot 51*b* describing the output port reflection coefficient S22, a third plot 51*c* describing the input port-output port gain coefficient S21, a fourth plot 51*d* describing the coupled port 16 reflection coefficient S33, a fifth plot 51*e* describing the ballasting port 18 reflection coefficient S44, a sixth plot 51*f* describing the coupling port-ballasting port gain coefficient S43, and a tenth plot 51*j* describing the output port-ballasting port gain (coupling) coefficient S42.

Figure 13:
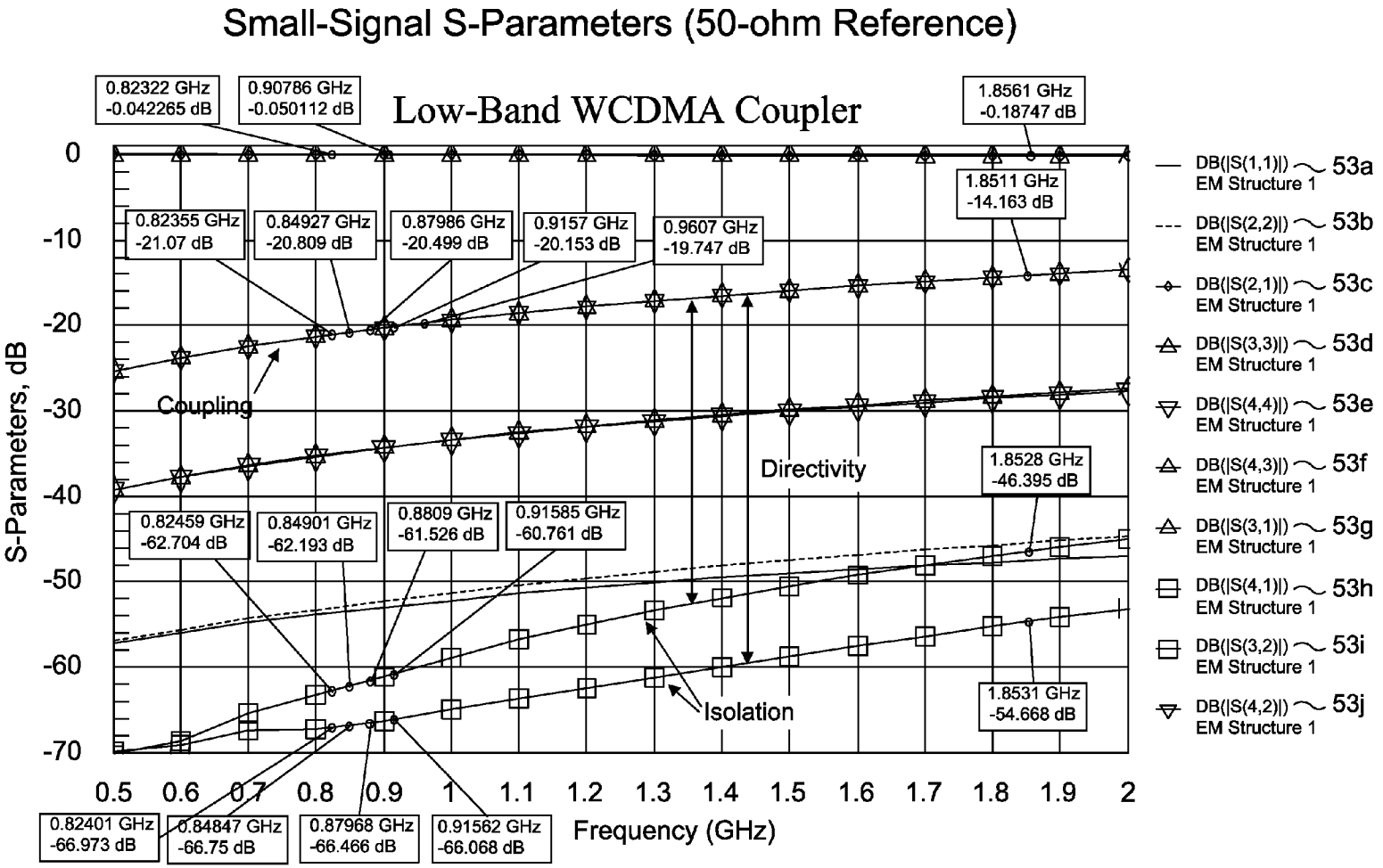
FIG. 13 is a graph showing the scattering parameters of the directional coupler shown in FIG. 10

The difference between the coupling factors at particular operating frequencies, and the corresponding first and second isolation factors at such operating frequencies, respectively define a first directivity and a second directivity. As indicated above, the first directivity is different from the second directivity, that is, the directional coupler 10 is asymmetric. The graph of FIG. 9 illustrates a simulated example of the directional coupler as shown in FIGS. 6-8D. As can be seen, the coupling is approximately 20 dB in high-band and the directivity is greater than 40 dB in high-band. Similarly, FIG. 13 illustrates a simulated example of the directional coupler as shown in FIGS. 10-12D. As can be seen, again the coupling is approximately 20 dB and the directivity is greater than 45 dB in the low-band, as illustrated by the plots 53*a*-53*j* wherein the letters refer to the same plot lines as described above in relation to FIG. 9.

Figure 14:
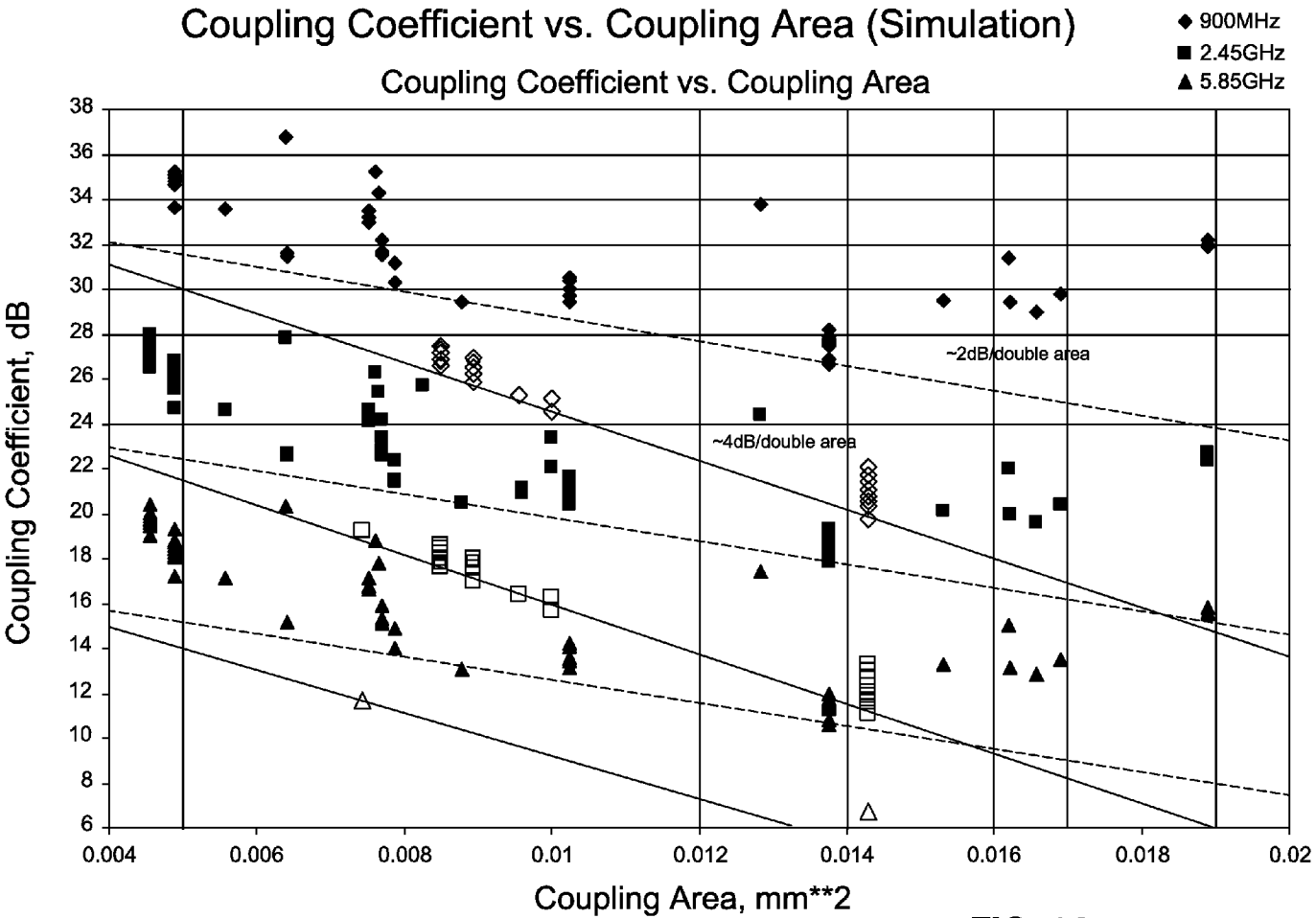
FIG. 14 is a graph plotting the coupling coefficient in relation to the overall footprint area of the directional coupler of the present disclosure in comparison to a prior coupler.
Figure 15:
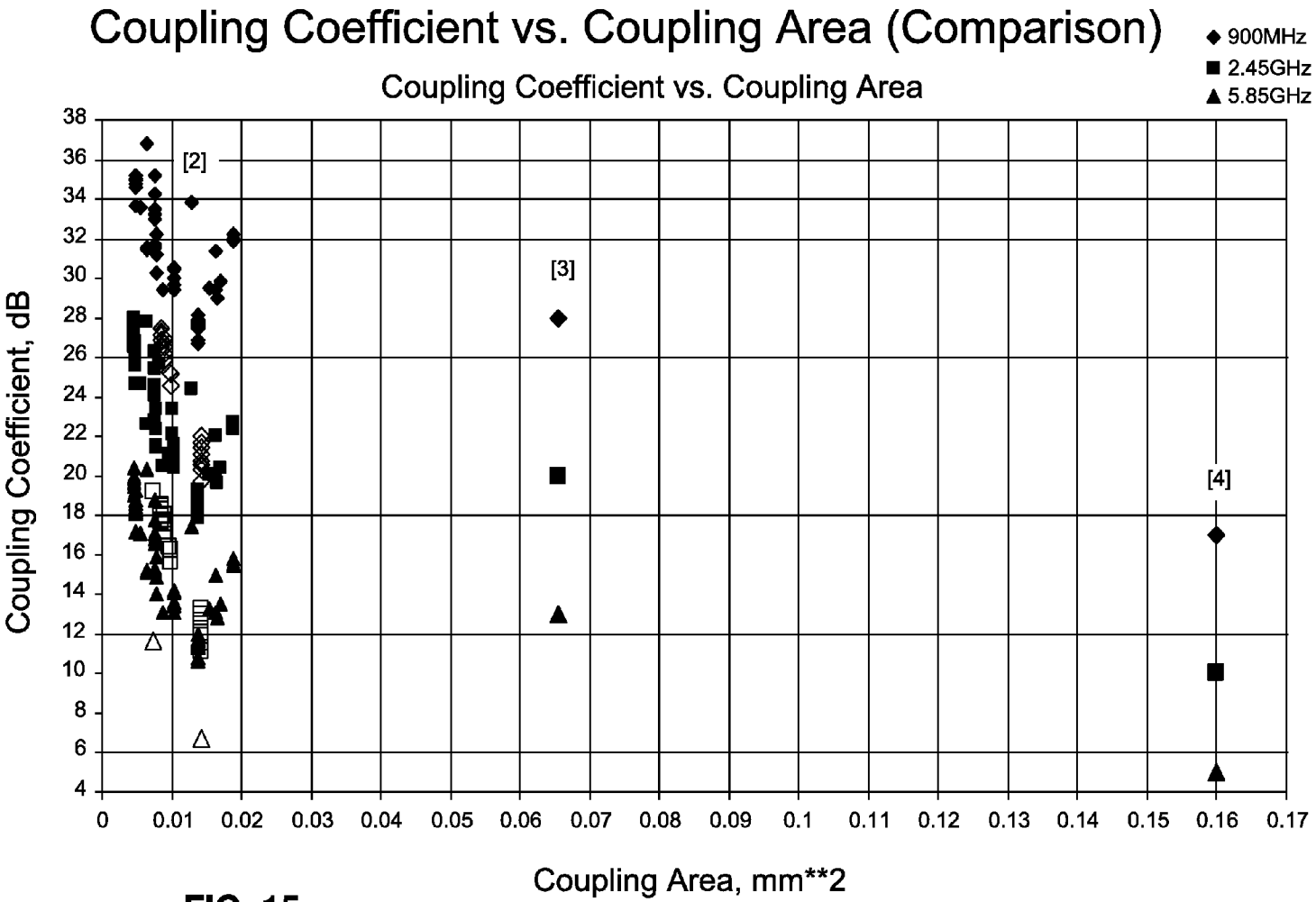
FIG. 15 is a graph plotting the coupling coefficient in relation to the overall footprint area of the directional coupler of the present disclosure in comparison to various prior art couplers.

It is expressly contemplated that various optimizations of the directional coupler are possible with respect to the number of stubs utilized and the overall footprint area in order to maximize coupling and directivity, while also minimizing series loss. Indeed, the overall footprint area of the directional coupler 10 affects the coupling factor, directivity, and series loss. The graph of FIG. 14 plots at various operating frequencies, including 900 MHz, 2.45 GHz, and 5.85 GHz, the coupling factors of different overall footprint areas (both of the prior art, as indicated by dashed lines with filled plot points, and of the current disclosure, as indicated by solid lines with open plot points). Generally, as the footprint increases, the coupling coefficient decreases for the same frequency. Furthermore, for the same footprint at the same frequency, the coupling coefficient may be varied (typically around the 1 dB to 2 dB range) depending on the geometry of the coupler and the number of stubs utilized, as discussed above. As can be seen, the highest level of coupling coefficient changes with the rate of 2 dB per doubling of coupler area for the prior art, while it the rate is 4 dB for the structures disclosed herein. Accordingly, the footprint area of the present disclosure can be significantly smaller for the same coupling coefficient in comparison to that previously known. For example, a coupler for low-band cellular applications with a coupling coefficient of 20 dB can be realized in approximately 0.015 mm2 (approximately 120×120 μm footprint) by following the present disclosure, whereas the prior art would require a 0.025 mm2 (approximately 165×165 μm footprint). By achieving a significantly smaller footprint, one is able to reduce the manufacturing cost as well as decrease the insertion loss. Similarly the graph of FIG. 15 with extended coupling area range shows how obviously smaller the footprint of the present couplers (indicated by open plot points) may be compared to existing couplers (indicated by filled plot points) known in the art.

The various embodiments of the presently disclosed miniaturized directional coupler 10 are based on coupling a minimum of two primary inductors and two secondary inductors to substantially increase the coupling coefficient. The directional coupler utilizes two, three or four compensation capacitors, which are implemented as the distributed coupling of conductive traces that are incorporated into the directional coupler 10. The primary and secondary inductors may be implemented in different metal layers of the semiconductor substrate. Additionally, the particular configurations contemplated allow for high power levels due to higher breakdown voltages of the various components. As shown above, the high level of directivity can also be achieved based upon the tuning of the compensation capacitors at specific operating frequencies. Insertion loss is also minimized in the contemplated configurations of the directional coupler in part because of the small values of the coupled inductors and the reduced loss from the compensation capacitors. It is contemplated that different frequency bands, as well as applications, can easily be designed using the disclosure as a guide.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show details of the present invention with more particularity than is necessary for the fundamental understanding of the present invention, the description taken with the drawings making apparent to those skilled in the art how the several forms of the present invention may be embodied in practice.

What is claimed is:

1. A directional coupler comprising:

an input port;

an output port;

a coupled port;

a ballasting port;

a primary chain of inductors comprising a plurality of inductors connected serially, wherein a first inductor of the primary chain of inductors is connected to the input port and a last inductor of the primary chain of inductors is connected to the output port;

a secondary chain of inductors comprising a plurality of inductors connected serially, wherein a first inductor of the secondary chain of inductors is connected to the coupled port and a last inductor of the secondary chain of inductors is connected to the ballasting port;

a first compensation capacitor connected to the input port and the coupled port; and a second compensation capacitor connected to the input port and the ballasting port;

wherein the primary chain of inductors is inductively coupled to the secondary chain of inductors.

2. The directional coupler of claim 1 wherein the primary chain of inductors comprises two inductors and the secondary chain of inductors comprises two inductors.

3. The directional coupler of claim 2 wherein the physical arrangement of the inductors consists of an alternating pattern of the first primary chain inductor, the first secondary chain inductor, the second primary chain inductor, and the second secondary chain inductor.

4. The directional coupler of claim 2 wherein the physical arrangement of the inductors consists of the two primary chain inductors being located outside of the two secondary chain inductors, such that the arrangement follows the pattern of the first primary chain inductor, the first secondary chain inductor, the second secondary chain inductor, and the second primary chain inductor.

5. The directional coupler of claim 2 wherein the physical arrangement of the inductors consists of the two primary chain inductors being located next to the two secondary chain inductors, such that the arrangement follows the pattern of the first primary chain inductor, the second primary chain inductor, the first secondary chain inductor, and the second secondary chain inductor.

6. The directional coupler of claim 1 further comprising a third compensation capacitor connected to the input port and the first secondary chain inductor.

7. The directional coupler of claim 6 further comprising a fourth compensation capacitor connected to the input port and the output port.

8. The directional coupler of claim 1 further comprising a dielectric layer, wherein the inductors are spiral conductive traces.

9. The directional coupler of claim 8, wherein the primary chain of inductors and secondary chain of inductors are situated on different metal layers.

10. The directional coupler of claim 8 further comprising:

a first primary underpath formed on the dielectric layer connecting the input port to a first primary chain spiral conductive trace;

a second primary underpath formed on the dielectric layer connecting the first primary chain spiral conductive trace to a second primary chain spiral conductive trace;

a first secondary underpath formed on the dielectric layer connecting the coupled port to a first secondary chain spiral conductive trace;

a second secondary underpath formed on the dielectric layer connecting the first secondary chain spiral conductive trace to a second secondary chain spiral conductive trace.

11. The directional coupler of claim 10 further comprising at least one capacitive stub connecting the primary chain to the secondary chain.

12. The directional coupler of claim 10, wherein the primary chain has a first predefined width, the secondary chain has a second predefined width, the primary underpath has a third predefined width, the secondary underpath has a fourth predefined width, and the primary chain is separated from the secondary chain by a fifth predefined distance.

13. The directional coupler of claim 12, wherein the first predefined width is greater than the second predefined width.

14. The directional coupler of claim 13, wherein the third predefined width is greater than the first predefined width and the fourth predefined width is substantially equal to the second predefined width and the fifth predefined distance.

15. The directional coupler of claim 14, wherein the first predefined width is approximately 5 μm, the second predefined width is approximately 2.5 μm, the third predefined width is approximately 20 μm, the fourth predefined width is approximately 2.5 μm, and the fifth predefined distance is approximately 2.5 μm.

16. The directional coupler of claim 15, having a footprint area of approximately 105 μm by 85 μm.

17. The directional coupler of claim 15, having a footprint area of approximately 130 μm by 110 μm.

18. The directional coupler of claim 8, wherein the dielectric layer is on a semiconductor substrate.

19. The directional coupler of claim 8, wherein the dielectric layer is on a low temperature co-fired ceramic (LTCC) substrate.

20. The directional coupler of claim 8, wherein the dielectric layer is on a thin-film printed substrate.

21. The directional coupler of claim 8, wherein the dielectric layer is on a laminate substrate.

22. The directional coupler of claim 10, wherein the primary chain of inductors is disposed in a spaced, parallel and partially coextensive relationship with the secondary chain of inductors.

* * * * *